US011060313B2

(12) United States Patent
Weiss et al.

(10) Patent No.: US 11,060,313 B2
(45) Date of Patent: Jul. 13, 2021

(54) SYSTEMS AND METHODS FOR FLOOD PREVENTION AND PEST CONTROL

(71) Applicant: GHW Solutions, LLC, Fort Worth, TX (US)

(72) Inventors: Jonathon Weiss, Fort Worth, TX (US); Gerry Graham, Fort Worth, TX (US)

(73) Assignee: GHW SOLUTIONS, LLC, Fort Worth, TX (US)

( * ) Notice: Subject to any disclaimer, the term of this patent is extended or adjusted under 35 U.S.C. 154(b) by 0 days.

(21) Appl. No.: 17/095,573

(22) Filed: Nov. 11, 2020

(65) Prior Publication Data

US 2021/0062529 A1 Mar. 4, 2021

Related U.S. Application Data

(63) Continuation-in-part of application No. PCT/US2019/031838, filed on May 10, 2019.
(Continued)

(51) Int. Cl.
*E04H 9/14* (2006.01)
*E06B 9/02* (2006.01)
(Continued)

(52) U.S. Cl.
CPC ..... *E04H 9/145* (2013.01); *E02D 31/00* (2013.01); *E06B 9/02* (2013.01); *E03F 7/02* (2013.01)

(58) Field of Classification Search
USPC ..... 52/169.12, 169.14, 202, 203, DIG. 12, 52/741.4, 746.1
See application file for complete search history.

(56) References Cited

U.S. PATENT DOCUMENTS 4,425,744 A * 1/1984 Villareal ..... E04H 9/145 52/169.14
4,693,042 A * 9/1987 Villarreal ..... E06B 9/00 52/169.14
(Continued)

FOREIGN PATENT DOCUMENTS

FR 2531475 A1 2/1984
GB 2245297 A 1/1992

OTHER PUBLICATIONS

Shane Thomas, International Search Report and Written Opinion for PCT Application No. PCT/US19/31838, dated Jul. 19, 2019, 9 pages, USPTO, Alexandria, VA.

*Primary Examiner* — Brian E Glessner
*Assistant Examiner* — Adam G Barlow
(74) *Attorney, Agent, or Firm* — Crain, Caton and James

(57) ABSTRACT

A comprehensive dry flood proofing system to mitigate inland flooding risk for existing or new homes and other buildings. The system leverages the home or building's structure to offer practical and affordable inland area flood protection for structures constructed with a slab on grade foundation. The system includes pluggable weep holes, entry door/garage door/window protectors, wall appurtenances and penetration protection, a house wrap and/or debris barrier for wall protection and sewage anti-backflow protection. The system is reusable, easy to deploy, does not detract from the home or building's permanent appearance, allows for ingress/egress during flood events and can protect the home or building from standing water up to 24" above slab elevation. The preparation and installation preflood, the deployment immediately preceding a flooding event and the subsequent removal after a flooding event can be provided by both contractors and homeowners.

13 Claims, 24 Drawing Sheets

Related U.S. Application Data

(60) Provisional application No. 62/983,834, filed on Mar. 2, 2020, provisional application No. 62/835,076, filed on Apr. 17, 2019, provisional application No. 62/802,734, filed on Feb. 8, 2019, provisional application No. 62/787,939, filed on Jan. 3, 2019, provisional application No. 62/670,416, filed on May 11, 2018.

(51) Int. Cl.
*E02D 31/00* (2006.01)
*E03F 7/02* (2006.01)

(56) References Cited

U.S. PATENT DOCUMENTS

| | | | | |
|---|---|---|---|---|
| 7,546,710 | B2 * | 6/2009 | Abbott | E06B 9/02 52/169.14 |
| 7,690,865 | B1 * | 4/2010 | Stewart | E02B 3/108 405/115 |
| 9,376,778 | B2 * | 6/2016 | Knezevich | E02B 7/54 |
| 9,453,314 | B2 * | 9/2016 | Cadogan | E06B 9/0692 |
| 10,844,563 | B1 * | 11/2020 | Coleman | E02B 3/106 |
| 2008/0008533 | A1 * | 1/2008 | Rehn | E04H 9/145 405/114 |
| 2014/0110066 | A1 * | 4/2014 | Rijlaarsdam | E02B 3/102 160/130 |
| 2017/0321475 | A1 * | 11/2017 | Quek | E04H 9/145 |
| 2018/0128002 | A1 * | 5/2018 | Quek | E06B 9/04 |
| 2019/0017315 | A1 * | 1/2019 | Barresi | E04H 9/145 |
| 2019/0203461 | A1 * | 7/2019 | Anderson | E04H 9/145 |
| 2020/0240138 | A1 * | 7/2020 | Ouimette | E04H 9/145 |

* cited by examiner

SYSTEMS AND METHODS FOR FLOOD PREVENTION AND PEST CONTROL

RELATED APPLICATIONS

This application claims priority U.S. Provisional Application No. 62/983,834, filed Mar. 2, 2020, and Patent Cooperation Treaty (PCT) Application No. PCT/US19/31838, filed May 10, 2019, which claims priority to U.S. Provisional Application No. 62/835,076, filed Apr. 17, 2019, U.S. Provisional Application No. 62/802,734, filed Feb. 8, 2019, U.S. Provisional Application No. 62/787,939, filed Jan. 3, 2019, and U.S. Provisional Application No. 62/670,416, filed May 11, 2018, each of which are incorporated herein by reference.

FIELD OF THE DISCLOSURE

The following disclosure generally relates to systems and methods for flood prevention and pest control. More particularly, the following disclosure relates to a removable, reusable dry flood proofing solution that is easy to deploy on short notice before a flood and economically leverages the structural support of the home.

BACKGROUND

Many communities around the world are facing the challenges and devastation caused by flooding due to the increasing frequency of severe weather events, rising sea level, subsidence and urban sprawl. Most agree that massive infrastructure projects aimed at flood control will never eliminate regional flooding in densely developed areas. Cities cannot be redesigned to incorporate dedicated catch basins, sufficient in size, to collect and control stormwater runoff from flooding caused by heavy precipitation. There is little doubt that torrential rains will continue to result from hurricanes and other storm-related events. Structures in populated areas along the thousands of miles of U.S. coastline and inland areas proximate to the Atlantic and Gulf of Mexico will continue to be exposed to flooding caused by major precipitation events, storm surge and other contributory causes. However, flooding of this nature is not limited to our domestic areas; it is of worldwide concern.

Flooding from Hurricane Harvey in late August 2017, for example, caused widespread destruction in the greater Houston area. Flooding due to heavy rains from Harvey damaged more than 200,000 homes and businesses. Superstorm Sandy was another costly weather event in recent history that damaged or destroyed at least 650,000 homes in the northeast part of the U.S. Hurricane Katrina in 2005 was the most destructive natural disaster in U.S. history causing total damages of about $150 billion and flooding of more than a million homes in and around New Orleans. Climatologists and meteorologists are convinced heavy precipitation storms are becoming more frequent and getting stronger, and lasting longer. Coastal, riverine and surface flooding will continue to threaten millions of homes and other buildings located in low lying areas around the world which brings significant adverse consequences to building owners, lenders, insurance/re-insurance providers, federal/local governments and other stakeholders.

In response to major, catastrophic flooding, various flood barrier systems have been developed for different applications and/or structures. Many conventional flood barrier systems, however, require expensive, unsightly, permeant structures that surround the home or other building. Others are removable, but are not practical for deployment on short notice, fail to economically leverage the structural support of the home and/or are not reusable.

BRIEF DESCRIPTION OF THE DRAWINGS

The present disclosure is described with reference to the accompanying drawings, in which like elements are referenced with like reference numbers, and in which.

DETAILED DESCRIPTION OF THE ILLUSTRATIVE EMBODIMENTS

Figure 1:
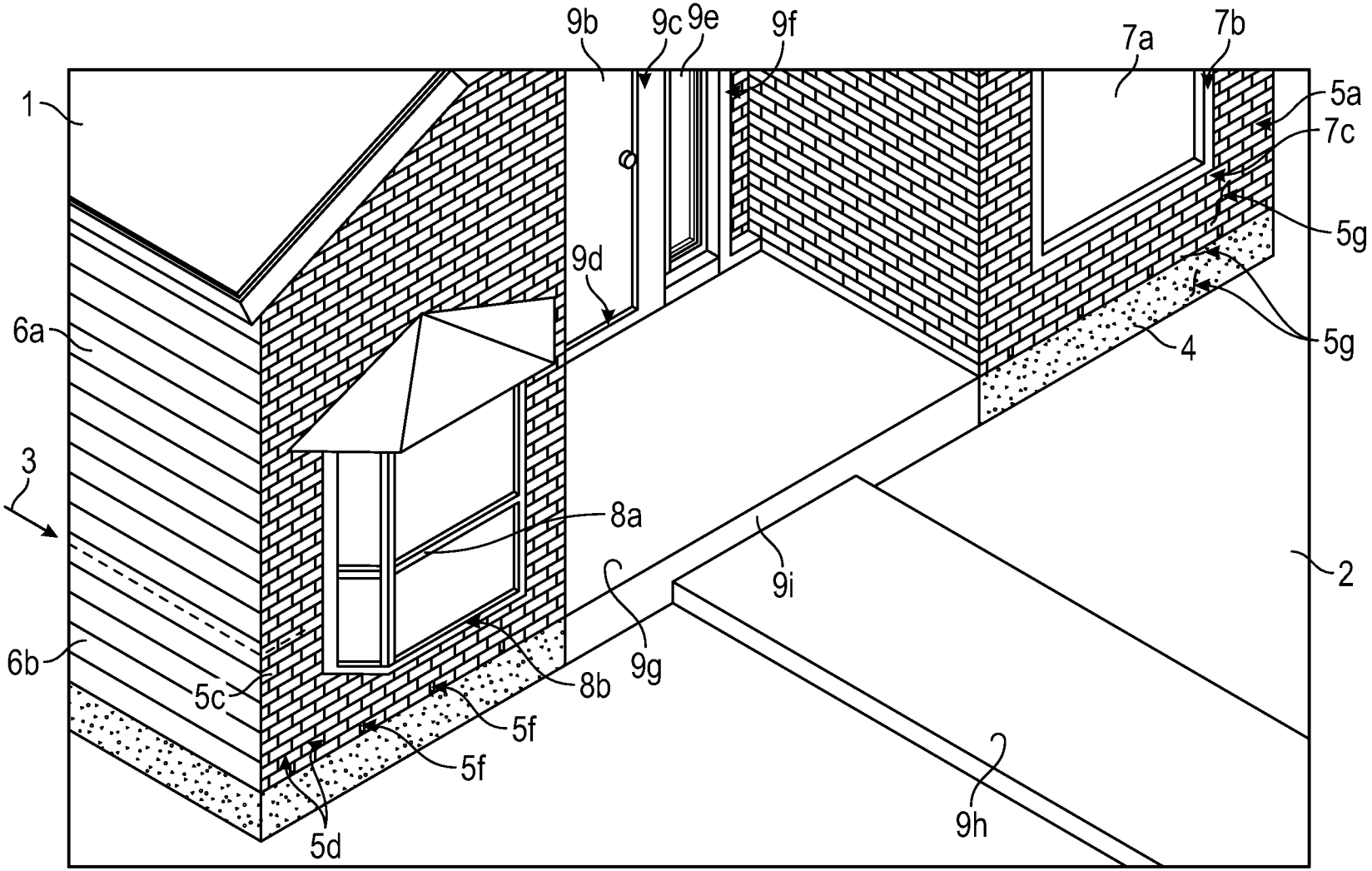
FIG. 1 is a perspective view of a typical home with different types of exterior wall materials.

The subject matter of the present disclosure is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures and dimensions described herein are only exemplary and are not intended to assert or imply any limitation with regard to the environment, architecture, design, or process in which different embodiments may be implemented.

The present disclosure is directed toward a comprehensive dry flood proofing solution with integrated reusable components that are easy-to-deploy within a few hours immediately preceding a flood event. All potential leak points into a building to a design flood elevation (DFE) of up to 24 inches from the top of a solid concrete foundation are addressed. The solution is suitable for existing homes, new homes and other building structures whereby the lowermost sections of the exterior walls are constructed using brick veneer, rock, stucco, wood/vinyl/composite siding, and/or other materials, which are sufficient to withstand the hydrostatic pressure caused by gently rising water up to the height of the DFE without structural failure. The suggested DFE height limitation of this disclosure is to mitigate possible damage to the foundation and other structural components of the building caused by buoyancy forces caused by rising flood waters on the outside of the house exceeding the weight of the structure and collapse forces related to the hydrostatic pressure applied against the exterior walls below the DFE.

The integrated dry flood proofing technology of the present disclosure also leverages the structural integrity of the building's concrete foundation and its exterior walls together with innovative solution components to enable cost effective protections, while allowing for ingress and egress during flood events. The solution includes a pre-flood preparation and installation process (pre-flood prep), which should be completed in fair weather well in advance of any storms. The pre-flood prep process generally includes inspecting the home, designing the customized dry flood proofing solution, and preparing the landscape in close proximity to the building structure (e.g. trimming shrubbery), exposed concrete slab, and house exterior from ground level elevation (GLE) to the DFE (e.g. pressure washing) for application of the treatments and installation of solution components. In addition, certain building construction defects are addressed (e.g. cracks in exposed concrete foundation), exterior masonry walls are sealed to the DFE, pluggable retro-fit weep holes are installed, and deployable solution components are custom-fitted and labeled during the pre-flood prep process to facilitate emergency deployment by two or more physically capable adults during inclement weather.

The systems and methods disclosed herein thus, overcome the prior art disadvantages associated with conventional flood barrier systems with a house wrap system that is reusable, easy to deploy on short notice and economically leverages the structural support of the home or building. The house wrap system disclosed herein is also durable and will not detract from the appearance of the home. The benefits further extend to other stakeholders including, but not limited to, federal and local governments, insurance companies, mortgage lenders and home owner associations.

In one embodiment the present disclosure includes a method for protecting a home or building with a slab-on-grade foundation from flood waters, which comprises: i) securing a zip-lock strip along a section of the foundation adjacent at least one exterior wall; ii) attaching at least two vertical wall risers to the exterior wall or the foundation above the zip-lock strip, wherein each vertical wall riser is separated from an adjacent vertical wall riser by a predetermined distance and includes a top end extending at least to a predetermined design flood elevation (DFE); iii) interlocking a bottom end of a water proof, flexible sheet and the zip-lock strip to form a bottom-end horizontal water-resistant barrier, wherein a top the end of the flexible sheet includes an integral sleeve; iv) inserting a stiffener through the integral sleeve for lateral support of the top end of the flexible sheet; v) securing a foam gasket over the integral sleeve containing the stiffener using a plurality of clips or clamps; vi) positioning the foam gasket and the integral sleeve containing the stiffener behind the top end of each vertical wall riser to form a top end horizontal water-resistant barrier at or above the DFE; vii) securing at least one side of the flexible sheet between a flexible spring bar and a spring bar foam gasket, with a predetermined length, to form a vertical water-resistant barrier near the at least one side of the flexible sheet FIG. 1 illustrates a perspective view of an existing building 1 constructed using a combination of brick-veneer exterior walls 5*a* and composite siding exterior walls 6*a* over a solid concrete foundation 4, which includes recessed windows 7*a*, bay windows 8*a*, entryway windows 9*d*, a door at the front entryway 9*b*, front porch substrate 9*g*, walkway substrate 9*h*, a transition step from the walkway to the front porch 9*i*, mortar seams 5*d* in the brick-veneer walls 5*a*, and existing weep holes 5*f* formed by excluding the mortar from vertical seams along the first row of bricks of wall 5*a* adjacent to the top of the concrete foundation 4 at a spacing typically not greater than 33 inches. Potential water entry locations during a flooding event from GLE 2 to the DFE 3 of up to 24 inches above the top of concrete slab 4 include (a) existing weep holes 5*f*, (b) permeable bricks 5*c* of walls 5*a*, (c) cracks and other defects 5*g* in the concrete foundation 4 and masonry exterior wall 5*a*, (d) planks 6*b* of composite siding walls 6*a*, (e) frames, jambs, sills, and thresholds 9*c*, 9*d* of door 9*b*, and (f) frames, jambs, sills, and casings 7*b*, 7*c*, 8*b*, and 9*f* of windows 7*a*, 8*a*, and 9*e*.

Figure 2:
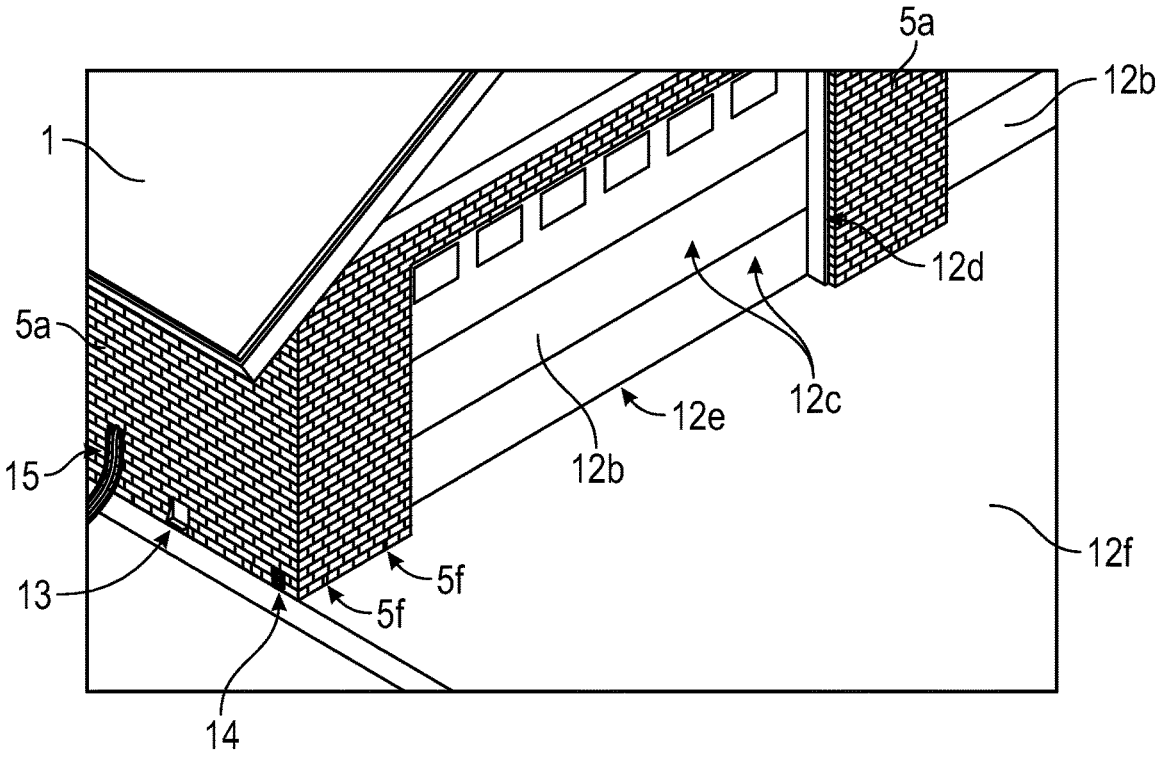
FIG. 2 is another perspective view of a typical home showing a garage and other features.

FIG. 2 illustrates another perspective view of building 1 highlighting additional potential leak points during a flooding event including (a) between the panels 12*c* of a sectional-type garage doors 12*b*, (b) along the bottom 12*e* of garage doors 12*b* adjacent to driveway 12*f*, (c) along the frames 12*d* of garage doors 12*b*, (d) exhaust vent 13, (e) electrical outlet 14, and (f) electrical, plumbing, and HVAC wall penetrations 15. In addition to potential leak points along the exterior of the house, flood waters can also cause sewage backup into toilets, shower, bathtub, and other drains located in the interior of the house on the ground floor.

The present disclosure includes five main integrated systems to protect existing homes from water encroachment during moderate flooding events into each of the previously described potential leak points: (a) Pluggable Weep Hole System, (b) Door and Window Protectors, (c) Wall Appurtenance Protection System, (d) Sewage Anti-Backflow System, and (e) House Wrap System.

Pluggable Weep Hole System:

The Pluggable Weep Hole System includes retro-fitting homes constructed with masonry-veneer exterior walls with pluggable weep hole having integral removable screen inserts, and further sealing all masonry leak points below the DFE with specialty chemicals. By design, exterior walls constructed with masonry-veneer are not waterproof and can become saturated during extended rainy weather events causing moisture to build-up in the annulus between the exterior masonry veneer and sheathing material of the interior structural wall. International Building Code (IBC) Section R703.7.6 requires weep holes be provided immediately above the flashing at the top of the concrete foundation with a maximum spacing of 33" and a diameter of not less than 3/16" to allow for drainage and air circulation to reduce long-term moisture build-up in this annulus space. Weep holes may also be located below exterior windows. For homes constructed using brick-veneer exterior walls, weep holes are typically formed by not applying mortar to approximately every second or third vertical joint on the first row of bricks adjacent to the concrete foundation. Weep holes provide an unwanted entry point for mice, lizards, snakes, wasps, bees, cockroaches, and other pests. Also, during flooding events, weep holes represent a problematic water leak point into the interior of the building.

To address these issues, the pre-flood prep process for homes constructed with masonry-veneer exterior walls includes first trimming low-lying shrubs and landscape growing within approximately 12" of the house exterior walls and foundation. Note that in cases where the House Wrap System will also be used for redundant protections, landscaping modifications may be necessary to expose at least 4" of vertical workspace along the side of the concrete foundation and/or to remove vines and other shrubbery growing against the exterior wall from GLE to the DFE.

Figure 3:
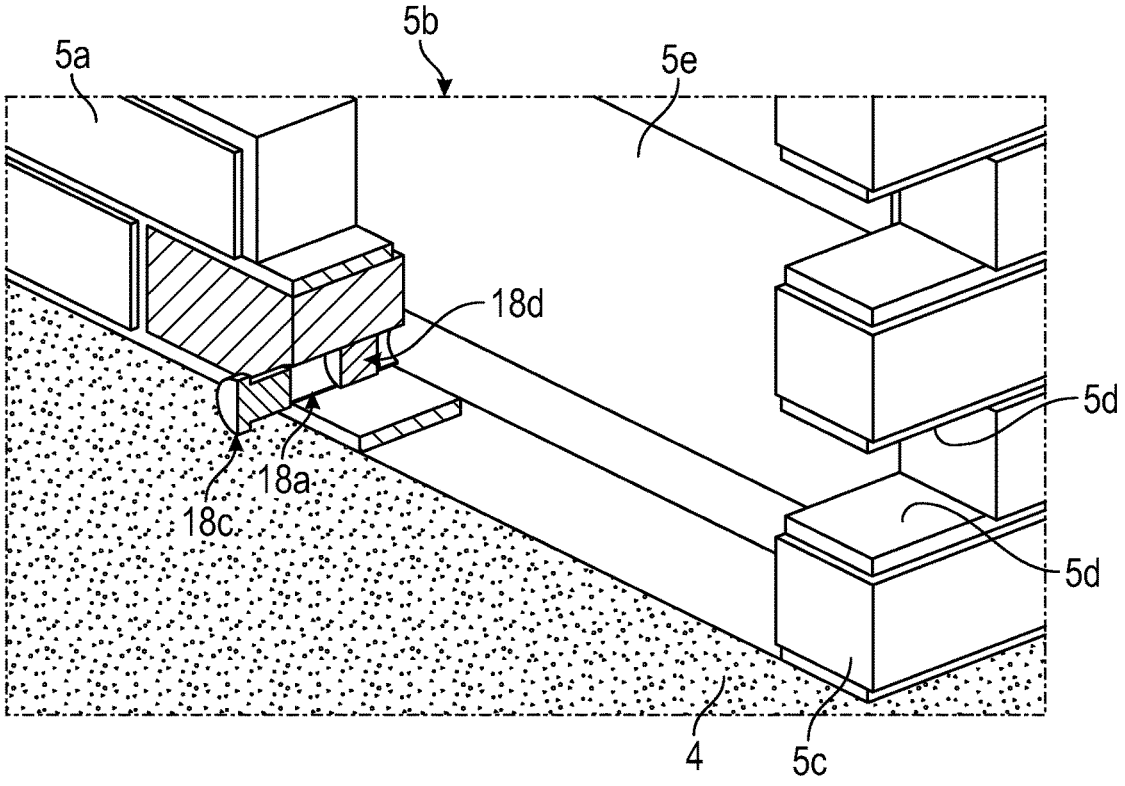
FIG. 3 is a perspective view of the home in FIG. 1 with a cut away illustrating a newly formed weep hole and weep hole plug.

Referring back to FIG. 1, the exposed side of the concrete foundation 4 and exterior brick-veneer walls 5*a* is cleaned using a water pressure washer from GLE 2 to the DFE 3 to prepare the surfaces for application of sealant chemical products. Grout sealant containing waterproofing agents and materials to match the color and texture of the existing mortar 5*d* is used to completely seal existing weep holes 5*f* after first inserting a flexible spacer device into each weep hole 5*f* to ensure the grout does not extrude into the ventilation cavity 5*e* located between the exterior wall 5*a* and the inner sheathing wall 5*b* immediately above the concrete foundation 4 as shown in FIG. 3. The grout sealant is applied with a consistent thickness to permanently seal the weep holes 5*f* from water intrusion during flooding after the sealant cures. A veneer of the same color and texture-matched grout sealant is also used to repair and permanently seal all of the existing mortar joints 5*d* along walls 5*a* from GLE 2 to the DFE 3 during pre-flood prep. Wall construction defects and leak paths 5*g* in the concrete slab 4 and exterior masonry-veneer walls 5*a* between GLE 2 and the DFE 3 are then repaired using suitable chemical sealant products.

Figure 4:
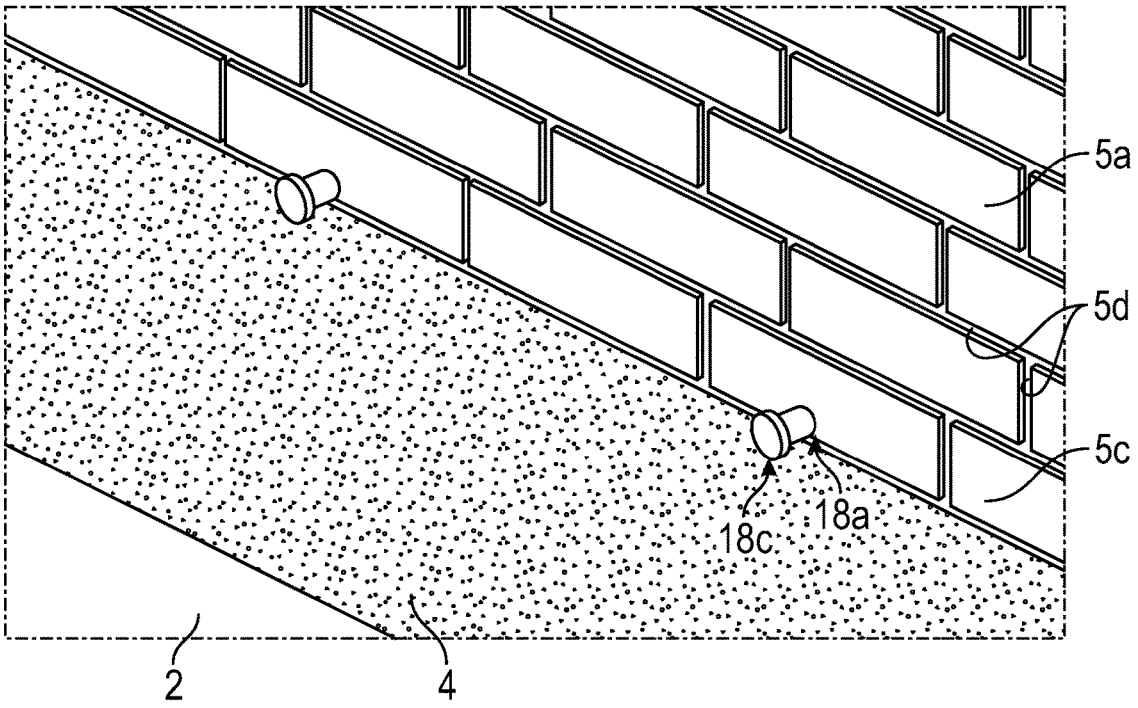
FIG. 4 is another perspective view of the home in FIG. 1 illustrating newly formed weep holes with weep hole plugs installed.

As illustrated in FIGS. 3 and 4, new weep holes 18*a* are then constructed by drilling or coring approximately 1" diameter holes through the brick-veneer wall 5*a* and into the ventilation cavity 5*e* located between the exterior wall 5*a* and the inner sheathing wall 5*b* immediately above the concrete foundation 4 (and optionally under windows which extend below the DFE 3). A high-speed drill and a diamond rotary coring bit configured with a depth control rod may be used for creating these new weep holes 18*a*. By design, the spacing of the new weep holes will be no more than 33" or the spacing specified in the local building code to ensure adequate inner wall ventilation. The new weep holes 18*a* will be visually inspected to ensure the new weep holes have a minimum of ¾" of effective sealing depth from the exterior face of the wall 5*a*. High-strength, epoxy-based grouting adhesive or other suitable chemical product may be applied on an as needed basis to fill any imperfections in the first ¾" of the new weep holes 18*a*. In these cases, the chemical filler product is allowed to fully cure before using a 1" diameter drill or grinder bit to ensure the bore of weep holes 18*a* are smooth. Removable, cylindrically-shaped weep hole pest control screen inserts 18*d* made from a weave of coarse-cut alloy metal fibers or other suitable material are then installed deep within the new weep holes 18*a* adjacent to the ventilation cavity 5*e*. During normal weather conditions, the system provides ventilation of the exterior wall cavity 5*e* and prevents rodents, reptiles, and large insects and embers or flames from entering the house through the weep holes 18*a*. Immediately preceding a flood event, weep holes 18*a* may be quickly sealed by deploying removable, weep hole sealing plugs 18*c* which are made from semi-malleable synthetic plastic cork or other suitable material. Plugs 18*c* are approximately 1¼" long with a tapered profile of approximately ⅞" to 1⅛" in diameter and have an integral T-shaped head to facilitate easy removal after the flood waters recede. Weep holes 18*a* may be quickly sealed immediately preceding a flood event and in inclement weather conditions by deploying plugs 18*c* into the holes 18*a* using simple tamping action with a rubber mallet or other suitable tool.

Figure 5:
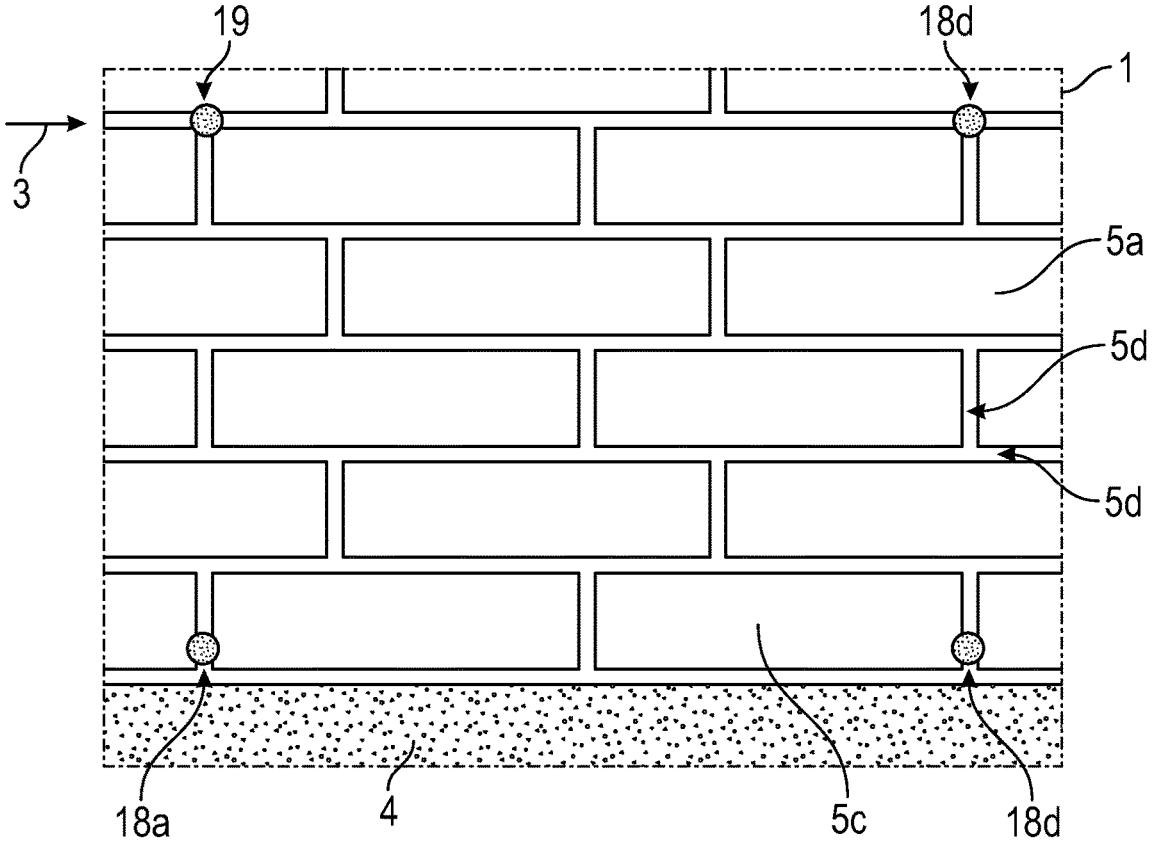
FIG. 5 is an elevation view of the home in FIG. 1 illustrating newly formed weep holes, and drain holes with pest control screen inserts installed.
Figure 6:
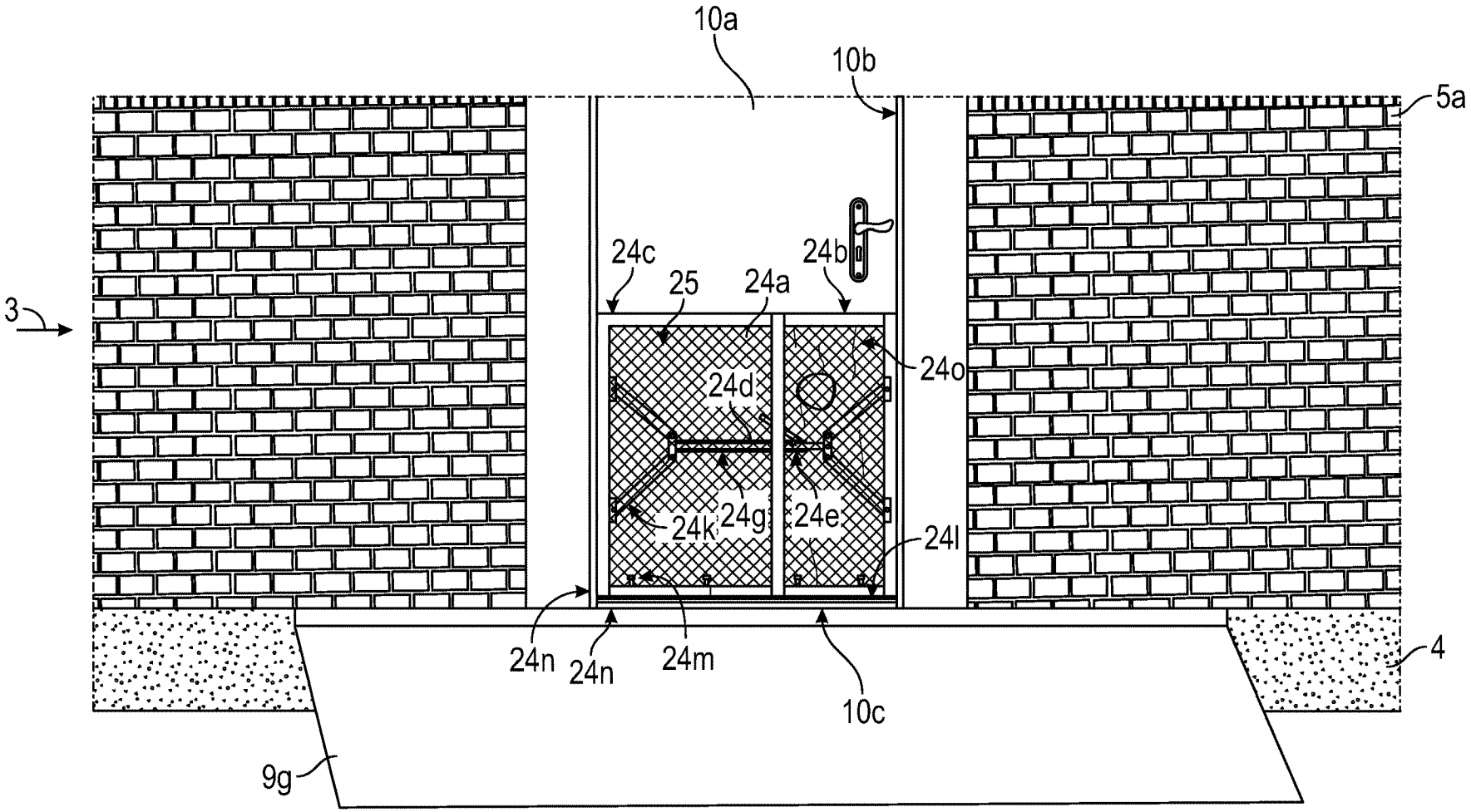
FIG. 6 is an elevation view of the home in FIG. 1 illustrating a re-deployable protector assembly for a door.
Figure 7:
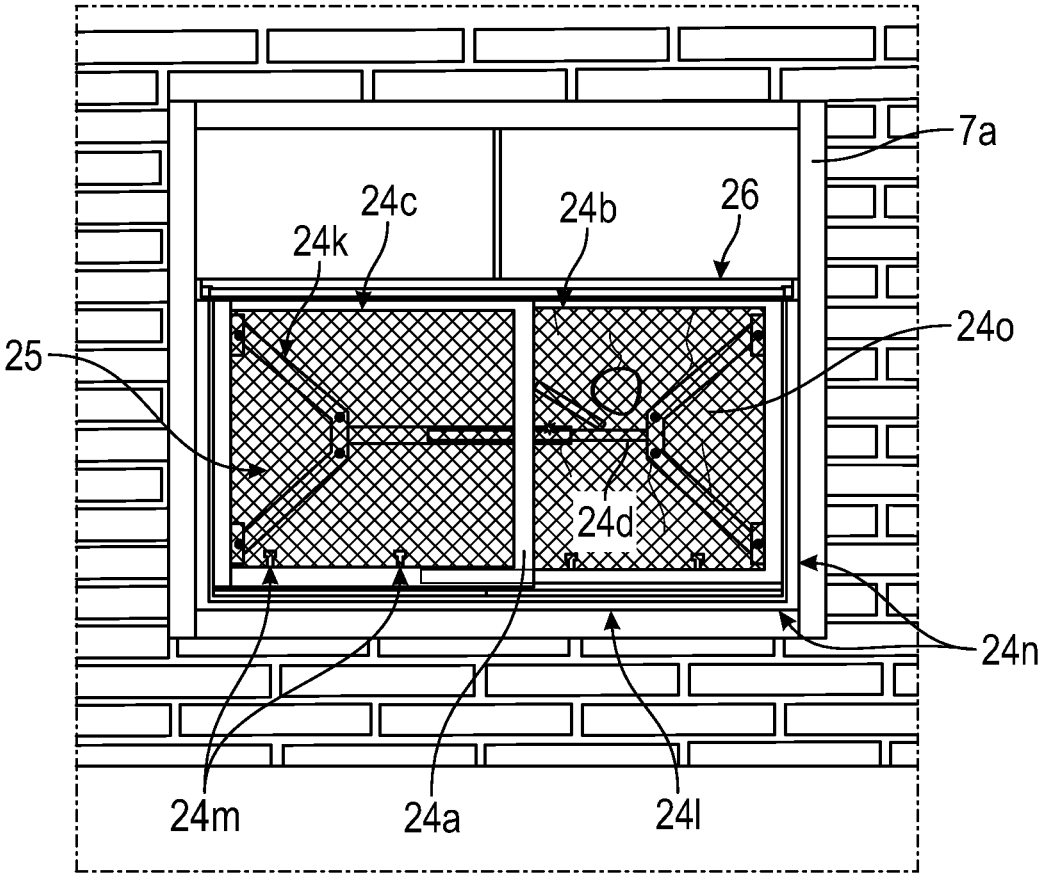
FIG. 7 is an elevation view of the home in FIG. 1 illustrating a re-deployable protector assembly for a recessed window.
Figure 9:
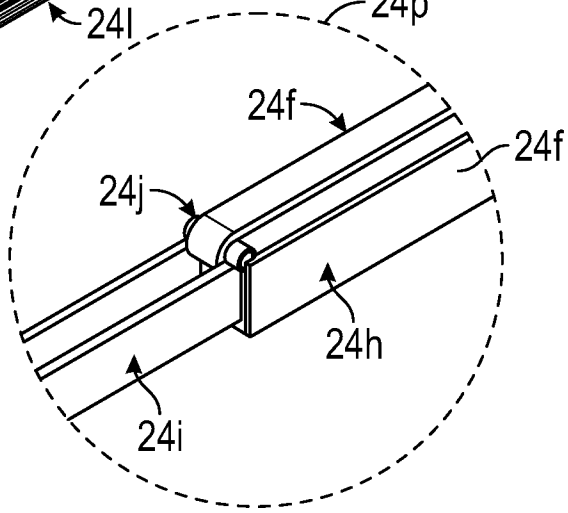
FIG. 9 is an expanded view of the area 24*p* in FIG. 8.
Figure 8:
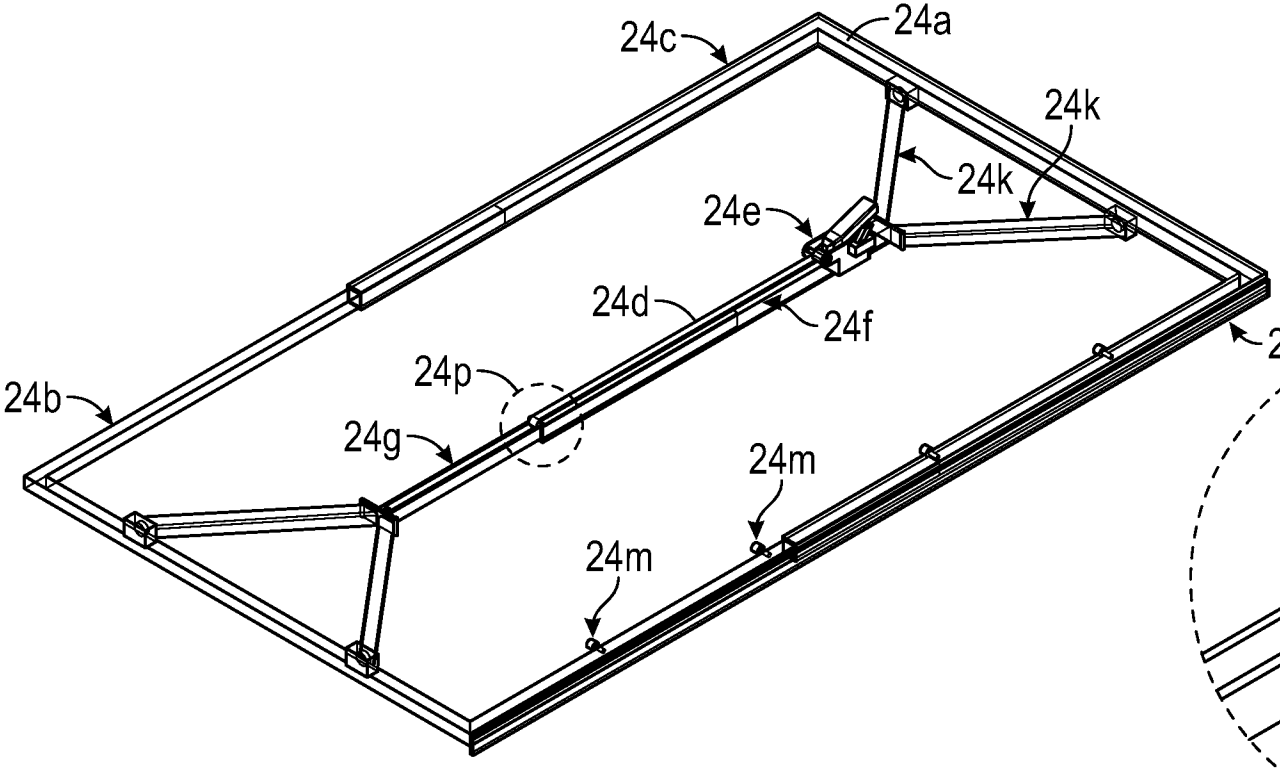
FIG. 8 is a perspective view of the protector assembly in FIGS. 6 and 7.

Referring now to FIG. 5, which is an elevation view of exterior wall 5*a* of building 1, illustrates how the dry flood proofing solution of the present disclosure is designed to ensure excessive collapse and buoyancy forces do not compromise the structural integrity of the building 1 should flooding exceed the DFE 3 of 24" above the top of the concrete foundation 4. A series of approximately 1" diameter drain holes 19 spaced along the sides of building 1 at unobtrusive locations are drilled through the masonry wall 5*a* and into the ventilation cavity 5*e* at or near the DFE 3 using a core drill, hammer drill and masonry bit or other suitable boring equipment with depth control rod to prevent penetration into the inner sheathing wall 5*b*. The orientation of the drain holes 19 at the DFE 3 will be inclined slightly upward to prevent wind-driven rain from entering the ventilation cavity 5*e* between the exterior masonry wall 5*a* and the inner sheathing wall 5*b*. Should flood waters exceed the DFE 3, water will enter the building 1 through the drain holes 19 preventing the collapse of exterior wall 5*a* and damage to the building foundation 4 from buoyancy effects. The drain holes 19 also are used to improve ventilation of annular space 5*e* between the exterior masonry wall 5*a* and the inner sheathing wall 5*b*. Screen inserts 18*d* are also inserted into drain holes 19 to prevent pests from entering the house through the drain holes 19. These DFE level drain holes may be temporarily plugged, if required, utilizing the weep hole plugs 18*c*. (i.e. pressure washing house, painting or sealing brick, ambient smoke event, blizzard winds, etc)

The final step in the pre-flood prep process for configuring the Pluggable Weep Hole System includes applying one or more coats of a suitable chemical sealant product to the exposed brick, rock, mortar, and concrete of exterior walls 5*a* and concrete foundation 4 using a spray gun, brush or other suitable application technique in a manner which leaves minimal visual impact on the appearance of the building 1 in order to waterproof the walls 5*a* and exposed foundation 4 from GLE 2 to the DFE 3. Ideally, the chemical sealant is fully transparent and will not leave a sheen after fully curing.

It is recommended to inspect the pluggable weep holes 18*a* on an annual basis to ensure the sealing surfaces are clean and the pest control screen inserts 18*d* are in good working condition. Plugged or damaged screens 18*d* may be removed using a simple J-hook device or simply punching them through the end of the weep holes 18*a* or drain holes 19 where they will rest in the annular cavity 5*e* located behind the exterior wall 5*a*. Additionally, it is recommended that the exterior walls 5*a* and the concrete foundation 4 from GLE 2 to the DFE 3 should also be inspected at least annually and any defects found should be repaired. Finally, it may be necessary to reapply the chemical sealant to the exposed brick, rock, mortar, and concrete of exterior walls 5*a* and concrete foundation 4 from GLE 2 to the DFE 3 as required to ensure the long-term effectiveness of the waterproof seal.

Door and Window Protector System:

Door and window protectors are custom-fitted assemblies that can be deployed in just minutes immediately preceding a flood event to effectively seal and protect exterior doors and low-lying recessed windows from standing water levels up to the DFE. After confirming the fit during pre-flood prep, each reusable assembly is labeled and stored along with the other deployable components of the present dry flood proofing solution to facilitate emergency deployment by the building owner or tenant immediately preceding a possible flood event. These protector assemblies do not require special pre-fabrication or modifications to door or window frames, however annual inspections of these areas of the building are recommended to ensure they (a) have been effectively sealed with waterproof caulking material and (b) can support the protectors along with the forces imposed by a column of water from the base of the doors and/or windows to the DFE and hydrodynamic forces including the impact of floating debris after deployment. Door and/or window screens may need to be removed prior to emergency deployment of the protectors. Protectors are designed to be expandable should be available in a variety of standard size ranges (e.g. 12" and 24" height; 18"-32", 32"-46", 46"-60" and 60"-74" width) to accommodate different door and recessed window configurations. For inward-opening doors, deployed protectors do not prevent the door from being opened in the presence of flood waters up to the DFE to facilitate home ingress and egress during the flooding event.

Referring now to FIGS. 6-9, a re-deployable door and window protector assembly 24*a* is illustrated and includes the integration of several components and deployment techniques. The height of each protector assembly 24*a* is designed to extend from the base of an exterior door 10*a* or recessed windows 7*a* to at least the DFE 3.

Each protector assembly 24*a* is comprised of an approximately ½" aluminum or PVC hard plastic square tube male frame 24*b*, which telescopes into an approximate ¾" aluminum or PVC hard plastic square tube female frame 24*c* to enable expansion during deployment using a ratchet strap apparatus 24*d*. Each ratchet strap apparatus 24*d* includes a lever-actuated ratchet strap tightening device 24*e*, strap 24*f*, concentric square tube expansion bar 24*g* (approximately ¾" female 24*h* by ½" female 24*i*), ratchet strap spindle 24*j*, dual square tube (approximately ½") V-arms 24*k*, which are attached to female frame 24*c*, and adjustable male frame 24*b* of protector assembly 24*a*. Strap 24*f* runs from tightening device 24*e* along the outside of the outer female square tube 24*h* of expansion bar 24*g* in a direction away from tightening device 24*e*, around spindle 24*j*, and back along the inside of the female square tube 24*h* of expansion bar 24*g* toward tightening device 24*e*, and is anchored at the end of the inner male square tube 24*i* of expansion bar 24*g* to enable expansion and contraction of expansion bar 24*g* by actuating tightening device 24*e*. The main structural components of ratchet strap apparatus 24*d* are made from aluminum or other suitable materials. Ratchet strap tightening device 24*e* employs a tension-limiter to ensure all components of each protector 24*a* and the frame and jambs 10*b* of exterior doors 10*a* and frame, jambs, and casings 7*b* of recessed windows 7*a* are not damaged due to over extension of the protector assembly 24*a*.

Dual integral rigid plastic lattice-work panels 25 are deployed within rails located on the flood-side of the frames 24*b*, 24*c* of each protector assembly 24*a* to facilitate expansion and contraction of frames 24*b*, 24*c*. Panels 25 are designed to provide structural support for an approximately 1/16" thick neoprene or similar elastic waterproof fabric sleeve 24*o* (shown with transparency), which encases the flood-side of each protector assembly 24*a*. Prior to deployment of each protector assembly 24*a* adjacent to doors 10*a* and/or window 7*a*, the design requires temporary placement of approximately ¾" wide by 5/16" thick dense closed-cell foam gasket material 24*n* along the inside edges of frames, jambs, sills, and threshold 10*b*, 10*c* of doors 10*a* and/or the frames, jambs, sills, and casings 7*b*, 7*c* of recessed windows 7*a* or optionally along the left and right side termination of wall 5*a* adjacent to doors 10*a* and/or recessed windows 7*a*. Foam gaskets 24*n* provide an effective seal between each protector assembly 24*a* and the doors 10*a* and/or recessed windows 7*a*.

With the exterior doors 10*a* and/or recessed windows 7*a* temporarily in an open position, the design of the open-back sleeve 24*o* provides access to the lever-actuated ratchet strap device 24*e* for forcefully expand V-arms 24*k* of ratchet strap apparatus 24*d* along with the male frame 24*b* and female frame 24*c* of each protector assembly 24*a*. During emergency deployment immediately preceding a flood event, actuation of the ratchet strap apparatus 24*d* causes the male frame 24*b* and female frame 24*c* of each protector assembly 24*a* to compress gasket 24*n* which creates an effective seal between the waterproof sleeve 24*o* of protector assembly 24*a* and the inside edges of frames and jambs 10*b* of doors 10*a* and frames, jambs, and/or casings 7*b* of recessed windows 7*a* or optionally along the left and right side termination of wall 5*a* adjacent to doors 10*a* and/or recessed windows 7*a*.

An adjustable plate 241 is provided along the bottom of each protector assembly 24*a*, which can be easily adjusted downward using approximately four small bolts 24*m* to compress the bottom gasket seal 24*n* at the door thresholds 10*c* and/or window sills 7*c* after expanding the protector assembly 24*a* laterally to compress gasket 24*n* along the sides of doors 10*a* and/or recessed windows 7*a*. The open-back design of sleeve 24*o* also allows access to tighten bolts 24*m* from behind protector assembly 24*a* when the exterior doors 10*a* and/or recessed windows 7*a* are temporarily in an open position to facilitate deployment.

All-weather tape 26, designed to adhere to glass or other surfaces in either dry or wet conditions, is used to seal the top of the expandable waterproof sleeve 24*o* of each protector assembly 24*a*, which is deployed to protect recessed windows 7*a*. The top of the sleeve 24*o* is configured with slick-sided expandable material, which is optimized for use with the all-weather tape 26.

Wall Appurtenance Protection System:

The Wall Appurtenance Protection System includes a variety of molded covers, gaskets, fasteners and other materials for sealing electrical outlets, vents, HVAC/plumbing, and other wall penetrations located below the DFE while providing needed ventilation of exhaust vents above DFE via hooded snorkels.

Figure 10:
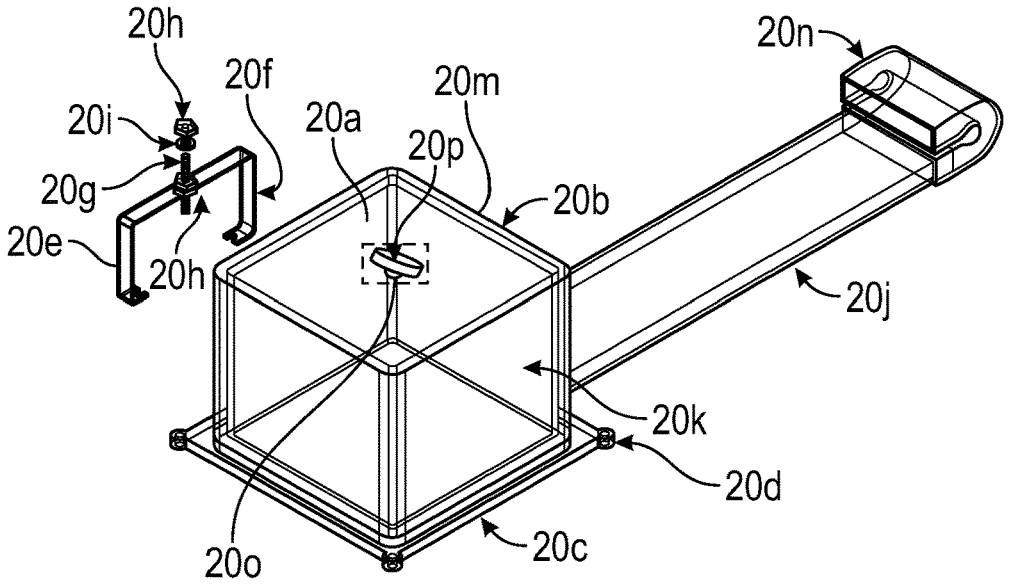
FIG. 10 is a perspective view of a cover used for protecting wall receptacles and vents during a flood.
Figure 11:
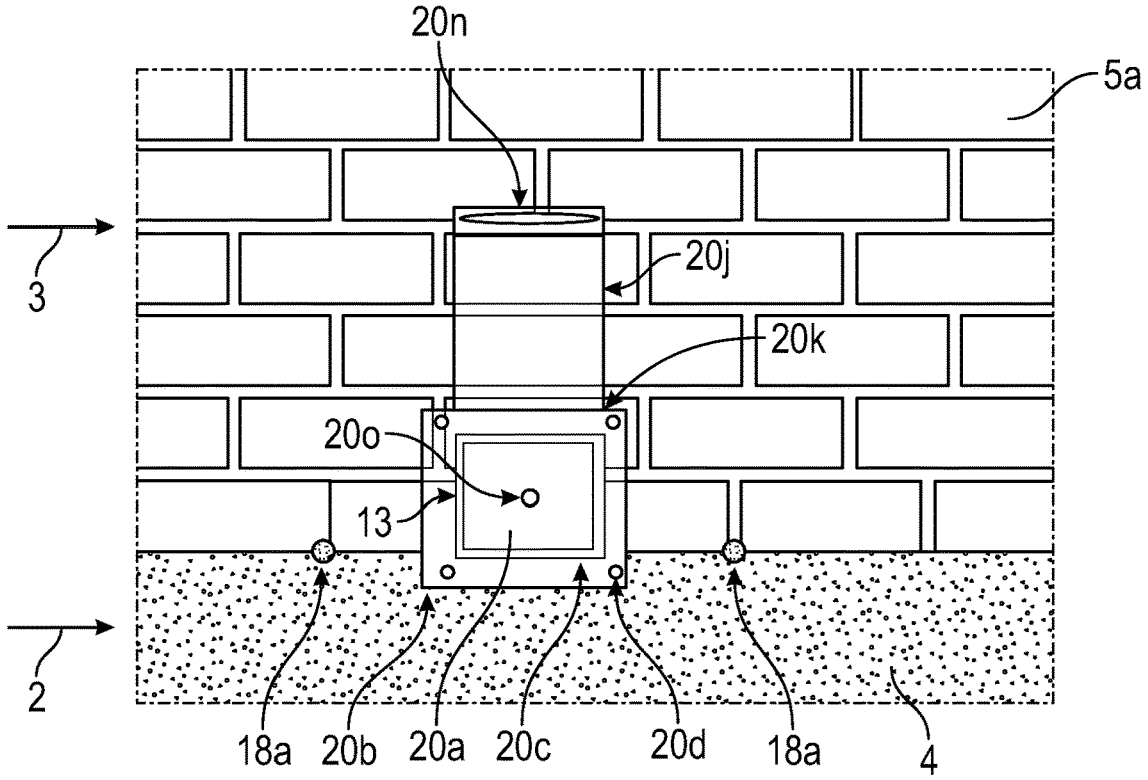
FIG. 11 is an elevation view of the home in FIG. 2 illustrating the cover in FIG. 10 for a vent.
Figure 12:
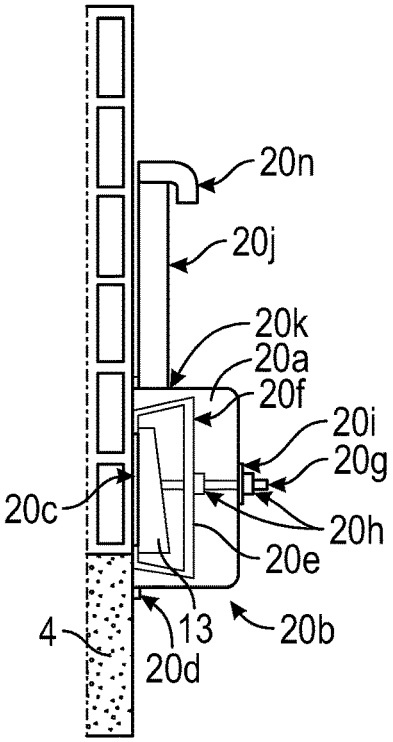
FIG. 12 is a side view of the cover in FIG. 11.

FIGS. 10-12 illustrate wall receptacle and vent cover apparatus 20*a* for sealing and isolating electrical outlets and other penetrations 14 located below the DFE 3 and protecting exhaust vents 13 while maintaining an air exhaust vent at the DFE 3. Flanged dome-shaped plastic housing 20*b* is sized to completely encase exhaust vent 13 or electrical outlet and other wall penetrations 14 protruding from the exterior wall 5*a* below the DFE 3 and are manufactured with four 5/16" diameter mounting holes 20*d* to receive optional ¼" screw or bolt in pre-set anchor fasteners. Approximately ½" thick by 1" wide closed-cell foam gaskets 20*c* are placed between the housing 20*b* and the exterior wall 5*a* during deployment to create a water proof seal after deployment of cover apparatus 20*a*. The housing 20*b* may be deployed immediately preceding the flood event using (a) spring steel "caliber-style" fasteners 20*e* with an integral ¼" stud 20*g* inserted through a 5/16" hole 20*o* in the center of housing 20*b*, (b) ¼" screws, or (c) ¼" bolts into pre-installed threaded anchors at each corner of the vent outlet 13 or other wall penetration 14 using housing 20*b* as template during pre-flood prep. An optional snap-in snorkel riser 20*j* having dimensions of approximately 1" depth by 5" to 7" wide by 36" tall and an O-ring seal 20*m* at its lower end may be snapped into fitting 20*k* of housing 20*b* when protecting exhaust vents 13. Prior to deployment of riser 20*j*, the removable cover of fitting 20*k* is removed. After deployment, the tube of snorkel riser 20*j* communicates the hooded vent 20*n* at the top of snorkel riser 20*j* located approximately at the DFE 3 with the convex housing 20*b* on its lower end. The top of riser 20*j* may be cut shorter to accommodate the specific DFE requirement. The hooded vent 20*n* is designed to slide over the top of the snorkel riser 20*j* to provide a leak point into the building 1 to mitigate risk of wall collapse should flood water rise above DFE 3; the hood 20*n* at the top of the snorkel riser 20*j* is designed to prevent rain from entering into snorkel riser 20*j* and housing 20*b*. If screw fasteners will be used for emergency deployment, four 3/16" diameter holes may be pre-drilled into exterior wall 5*a* or concrete foundation 4 using the mounting holes 20*d* in housing 20*b* as a template during the pre-flood prep, then filled with colored wax for protection and camouflage. If the cover 20*a* is deployed using the spring steel "caliber-style" fasteners 20*e*, snap-in plug 20*p* will be removed from the 5/16" hole 20*o* located in the center of housing 20*b*. To facilitate deployment of fasteners 20*e*, it may be necessary to use a Dremel®-like tool to create approximately ¾" slots on two opposite sides of the vent 13 or other outlet 14 to be protected to enable placement of the integral steel anchor claws 20*f* between opposite sides of the vent 13 or other outlet 14 and the wall 5*a*. An inner ¼" nut 20*h* may then be screwed onto stud 20*g* to tighten down and secure the "caliper-style" fasteners 20*e* before the housing 20*b* is attached. The housing 20*b* is tightened down to compress the foam gasket 20*c* using an outer ¼" nut 20*h* and sealing washer 20*i* on the stud 20*g*.

Figure 13:
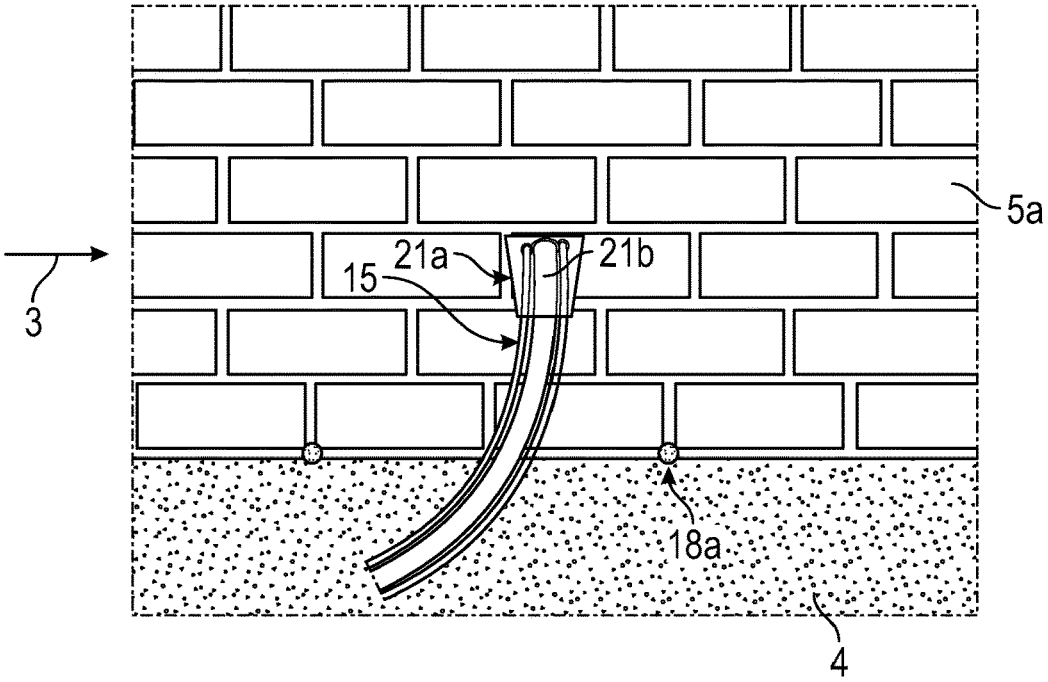
FIG. 13 is an elevation view of the home in FIG. 2 illustrating a system for sealing electrical and plumbing appurtenances.

FIG. 13 illustrates a system for sealing electrical and plumbing appurtenances 15 with a wall penetration located below the DFE 3. During pre-flood prep, plastic wrap-around cone 21*a* is installed by wrapping the cone 21*a* around appurtenances 15 immediately adjacent to exterior wall 5*a* when electrical and/or plumbing appurtenances 15 penetrate wall 5*a*. UV-protected spray-on foam water proof sealant 21*b*, which is capable of adhering to the rough surface of cone 21*a* and the surface of wall 5*a*, is then applied to completely fill cone 21*a* to create an effective water-proof seal around appurtenances 15 at the penetration with wall 5*a*.

Sewage Anti-Backflow System:

The Sewage Anti-Backflow System includes plugs deployed through toilet trapways to a location just below the wax ring, weighted seals for shower/other drains, and filling bathtubs with water to prevent ground floor sewage backflow during flooding conditions up to the DFE.

Figure 14:
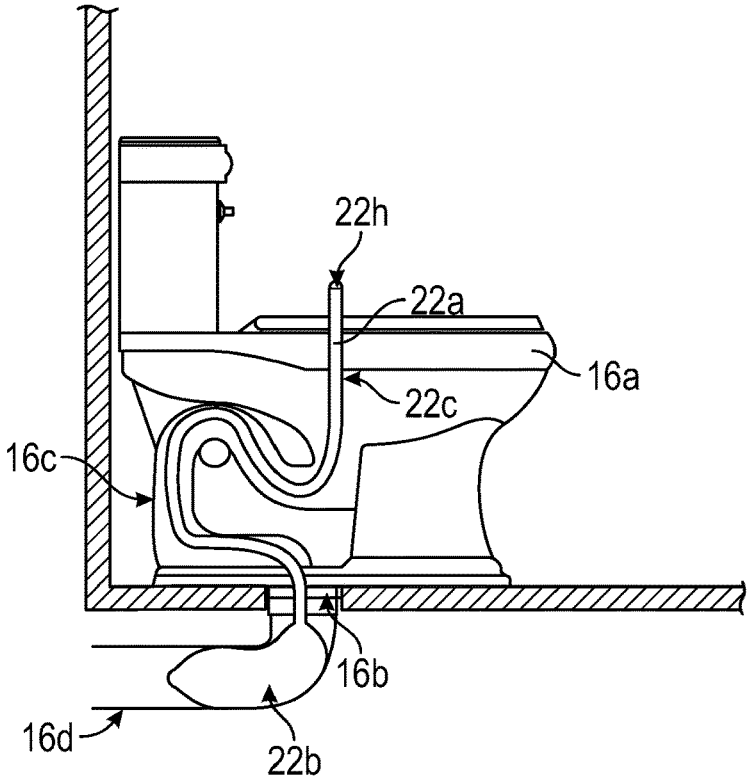
FIG. 14 is an elevation view of a device used for sealing a toilet during a flood.
Figure 15:
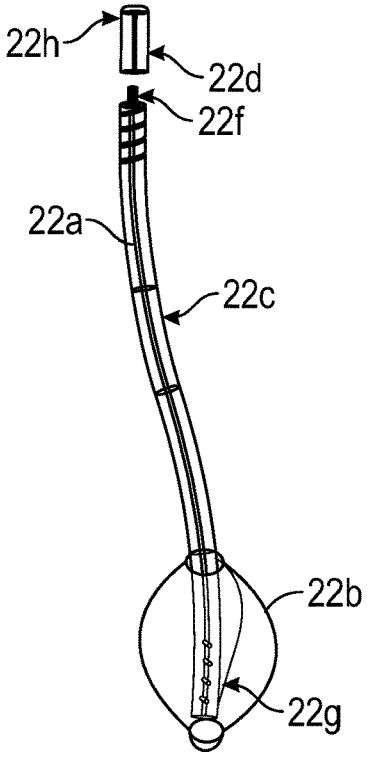
FIG. 15 is an elevation view of the toilet sealing device in FIG. 14.

FIGS. 14-15 illustrate a device for sealing the trapways 16*c* of toilets 16*a* located on the first floor of the building 1 at a location below the wax seal ring 16*b* at the lower end of toilet 16*a* immediately preceding an impending flood event. The air-inflatable bladder-type elastomer toilet plug 22*a* is designed to facilitate fast deployment through the toilet trapway 16*c* of toilet 16*a* to a location just below the wax ring 16*b* during an impending flood event. A Schrader valve assembly 22*f* is located at the upper end of the approximately ¾" diameter flex tube 22*c* for inflating and deflating the bladder 22*b*. The approximately 1¼" diameter bladder 22*b* in a deflated state will be pushed into and through the trapway 16*c*, then seated at a location immediately below wax ring 16*b* within the PVC sewage pipe 16*d* connected at the lower end of toilet 16*a*. The bladder 22*b* will then be inflated to approximately 10 psi using any suitable hand air pump with a pressure regulator to anchor and seal within PVC sewage pipe 16*d*. The toilet plugs 22*a* are designed to prevent sewage backflow through ground floor toilets 16*a* during flooding conditions. Toilet plug 22*a* can be easily removed by deflating bladder 22*b* using valve assembly 22*f* and pulling on the flex tube 22*c*.

Figure 16:
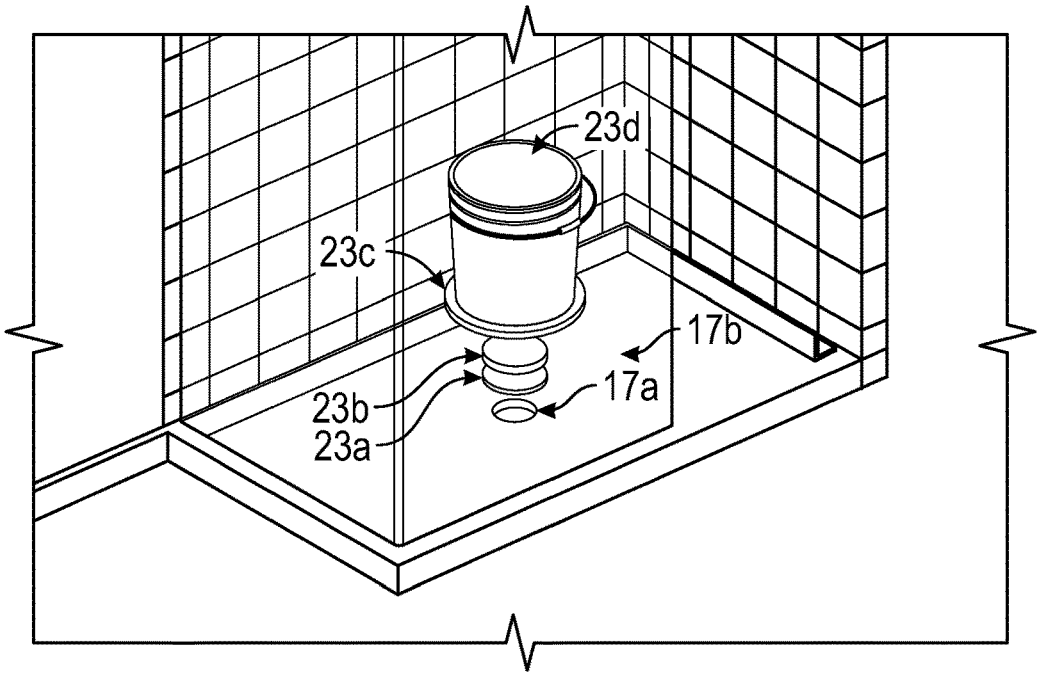
FIG. 16 is a perspective view of a system for sealing a shower drain during a flood.
Figure 17:
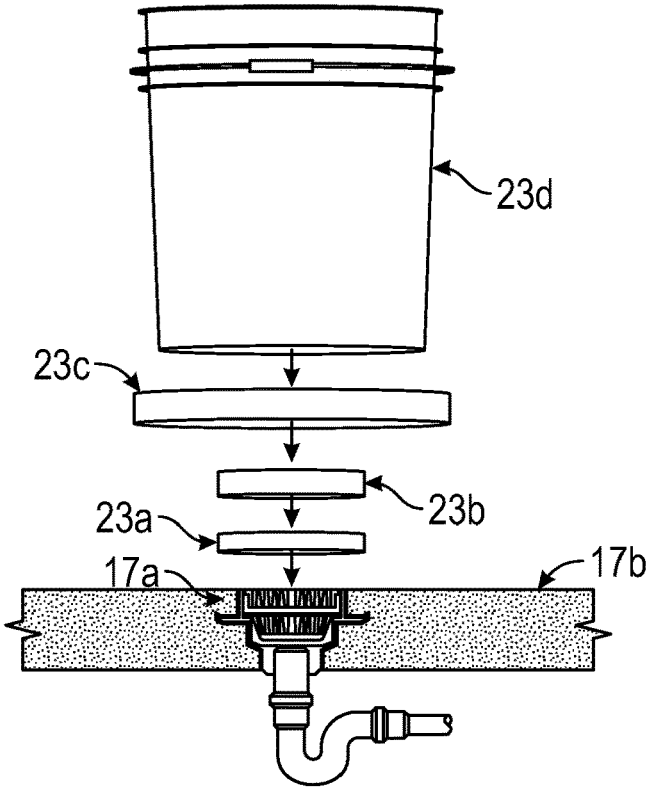
FIG. 17 is an exploded view of the shower drain sealing system in FIG. 16.

FIGS. 16-17 illustrate a system for preventing flood waters from causing sewage backup into approximately 3 to 4" diameter shower and/or floor drains 17*a* generally located at the lowest point of a gently sloping tile or other flooring substrate 17*b* on ground level in the building 1. An approximately 6" diameter by ½" thick waterproof, closed cell foam gasket 23*a* is used to effectively seal each of the drains 17*a* to prevent sewage backup caused by flood waters reaching the DFE 3 of approximately 24" of standing water. The emergency deployment process includes first centering gasket 23*a* over drain 17*a*, then placing an approximately 6" diameter by 1" thick hard solid plastic disk 23*b* directly over gasket 23*a*, then centering an approximately 12" diameter rigid plastic flat support structure 23*c* (e.g. the lid of a 5 gallon bucket) over disk 23*b*, then applying a minimum of 40 pounds of weighting material such as a water-filled 5 gallon bucket 23*d* or sand bags on top of the support structure 23*c*. The hydrostatic pressure from a 24" column of standing water is approximately 0.866 pounds per square inch, which will apply a potential upward force against the 6" diameter hard plastic cap 23*b* (28 sq. inches) of approximately 24 pounds, thus the recommended minimum weight of 40 pounds applied to disk 23*b* and underlying gasket 23*a* will be sufficient to ensure gasket 23*a* maintains an effective seal over drain 17*a*.

Ground floor bathtubs will be protected by plugging the drain and filling the bathtub with water to overflow vent and optionally placing a sand bag on top of plug if more weight is needed to address 24" DFE requirement (not shown).

House Wrap System:

The House Wrap System is a highly configurable, integrated solution for protecting exterior walls, doors, and windows to the DFE using pre-fitted, scrim-reinforced polyethylene sheeting (or similar waterproof sheeting material) and debris barrier netting, which are deployed immediately preceding a flood. Other solution components include plastic zipper technology, spring-loaded bars, gaskets, spacer blocks, and fastening apparatus. This system is uniquely designed to protect low-lying bay windows, garage door areas, and exterior walls, which are not constructed using brick or masonry veneer, but may also be used as an alternative method to protect recessed windows and exterior doors and/or for redundant protections when used along with the other systems described herein. Poly-wrap sheeting panel should always be secured in the vertical and horizontal positions with some "slack" to allow conformance to the house structure when hydrodynamic forces are applied in order to minimize stress on appurtenances around the building, poly-wrap sheeting panels, and other House Wrap System components.

Figure 18:
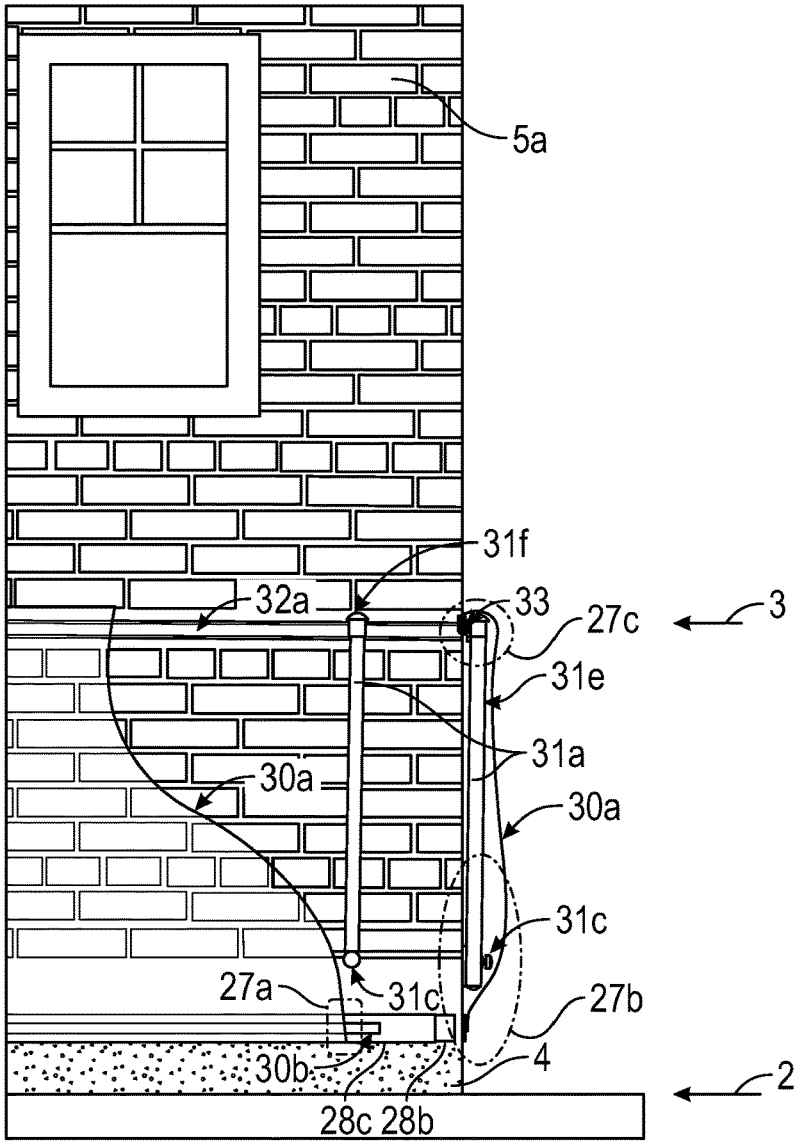
FIG. 18 is an elevation view of the home in FIG. 1 illustrating a house wrap system.

FIG. 18 illustrates the basic House Wrap System. A poly-wrap sheeting panel 30*a* is manufactured in continuous rolls from clear, laminated, reinforced film made of a dual layer of vapor-proof linear low-density polyethylene (LLDPE) with an inner layer of polyester string reinforcement scrim to increase puncture and tear resistance or another suitable waterproof sheeting material. If LLDPE sheeting material is used, the recommended sheeting thickness of sheeting panel 30*a* is approximately 10 mils to mitigate the risk of wind and puncture damage. The sheeting panel 30*a* will be manufactured in various widths (e.g. 24", 30", 36", and 46") to facilitate custom configuration and fitting during pre-flood prep.

Figure 19:
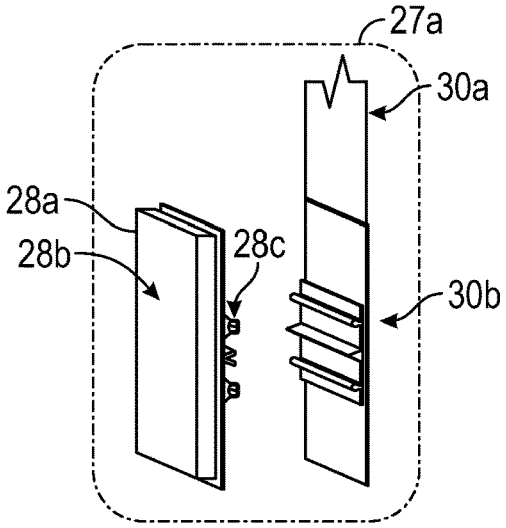
FIG. 19 is an expanded view of the area 27*a* in FIG. 18 illustrating panels and zipper strips used in the house wrap system.

FIG. 19 illustrates a perspective view of an integral dual male plastic zipper connection 30*b* provided along the lower edge of panels 30*a* in order to mate with the dual female zipper connections 28*c* hosted on zipper strips 28*a*, which are anchored and sealed to the side of the concrete building foundation 4 above, but in close proximity to GLE 2 during pre-flood prep. The first tongue and groove connector of dual female zipper connection 28*c* and dual male zipper connection 30*b* is optimized for creating an effective water tight seal using a relatively soft, more malleable plastic tongue n' grove connection (e.g. Ziploc®). The second connector of dual female zipper connection 28*c* and dual male zipper connection 30*b* is optimized for creating a higher tensile strength anchor using a harder, less pliable plastic. The purpose of this plastic zipper technology is to secure and seal the bottom of the sheeting panel 30*a* to the side of the concrete building foundation 4.

During the pre-flood prep process in dry weather conditions, approximately 1" wide zipper strips 28*a*, also made from LLDPE plastic or other suitable base sheeting material, are permanently installed in a continuous horizontal orientation onto the exposed sides of the exposed concrete building foundation 4 near GLE 2 using butyl tape 28*b* or similar adhesive that is waterproof, strong, flexible, and tolerant of rugose surfaces. After installation, butyl tape 28*b* is waterproof, weather resistant, and can be completely submerged without losing adhesion to concrete. Zipper strips 28*a* are manufactured in bulk rolls with integral dual female plastic zipper connections 28*c* to facilitate anchoring and sealing with the dual male zipper connections 30*b* of panels 30*a* during emergency deployment. Butyl tape 28*b* may be manufactured as an integral component of the zipper strips 28*a* on the side opposite to the female zipper connections 28*c* or alternatively may be packaged separately in rolls with a protective wax strip to facilitate installation onto the zipper strips 28*a* around the exposed side of building foundation 4 during pre-flood prep. During installation, zipper strips 28*a* and butyl tape 28*b* may be cut-to fit using scissors to facilitate customized solutions to accommodate specific house wrap requirements. The butyl tape 28*b* used to install zipper strips 28*a* is designed to facilitate complete removal and replacement of zipper strips 28*a* after a service life of approximately 5 years. After installation, zipper strips 28*a* are protected from adverse environmental conditions (e.g. temperature, moisture, UV, inserts, rodents, and dirt) using camouflaged removable cover which incorporates dual male zipper connections (not shown).

Figure 20:
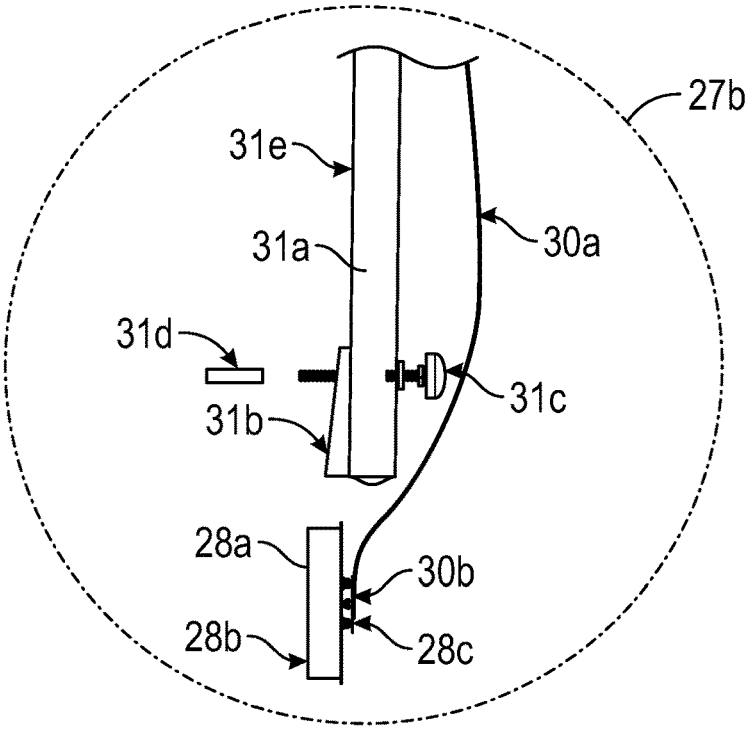
FIG. 20 is an expanded view of the area 27*b* in FIG. 18 illustrating a bottom section of a wall riser used in the house wrap system.
Figure 21:
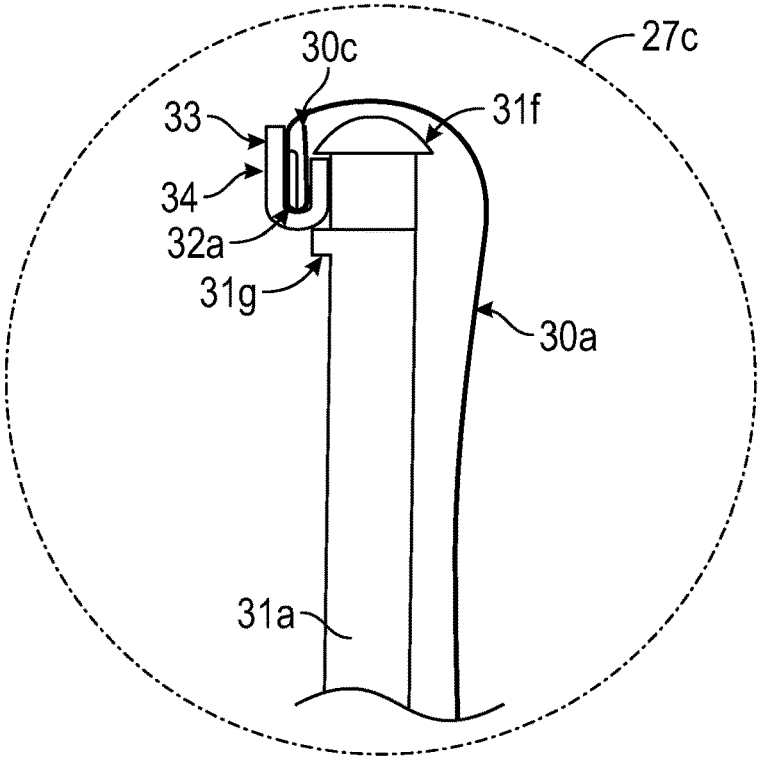
FIG. 21 is an expanded view of the area 27*c* in FIG. 18 illustrating a top section of a wall riser used in the house wrap system.

Referring now to FIGS. 20-23, a series of vertical wall risers 31*a* spaced laterally approximately every 4 feet along the base of the exterior walls 5*a*, 6*a* to be protected with the House Wrap System are used to provide vertical support for the poly-wrap panels 30*a* during emergency deployment immediately preceding an impending flood event. FIG. 20 illustrates a bottom cross section view of the integrated House Wrap System while FIG. 21 illustrates a top cross section view of the same system.

Each vertical wall riser 31*a* is manufactured with a ½" aluminum, PVC, or other hard plastic square tube riser 31*e* with a height sufficient to span the entire width of the sheeting panel 30*a* from the integral mounting flange 31*b* on its lower end to the rounded cap 31*f* at its upper end. The standard length of square tube riser 31*e* is approximately 28", but the top of the square tube riser 31*e* may be cut shorter during pre-flood prep as required before the rounded plastic riser cap 31*f* is slipped over top of riser to prevent damage to the poly-wrap sheeting panel 30*a* after emergency deployment.

Flange 31*b* is approximately ½" wide and 3" tall is canted at an angle from a vertical orientation using a tapered profile from approximately ½" at its bottom to ¼" at its top to provide force against the exterior wall 5*a*, 6*a* at the upper end of square tube riser 31*e* upon deployment. Each vertical wall riser 31*a* is deployed using a ¼" hex bolt 31*c* inserted through a 5/16" hole in the flange 31*b* at the lower end of the square tube riser 31*e* and screwed into a pre-set ¼" threaded masonry anchor 31*d* in the exposed side of the concrete building foundation 4 just below the bottom of exterior wall 5*a*, 6*a* or alternatively using a ¼" masonry screw fastener installed into a pre-drilled 3/16" hole in the side of the foundation 4. A rounded cap may be snapped onto the head of the bolt 31*c* after installation to protect the sheeting panel 30*a* from puncture damage or abrasion wear. To facilitate emergency deployment of vertical wall risers 31*a*, the ¼" threaded anchors 31*d* should be permanently installed at a spacing of approximately 4 feet into the exposed side of foundation 4 adjacent to exterior wall 5*a*, 6*a* during pre-flood prep. Similarly, if ¼" masonry screw fasteners will be used to deploy vertical wall risers 31*a*, the 3/16" holes should be drilled into the side of the foundation 4 during pre-flood prep.

Vertical wall risers 31*a* are used in conjunction with poly-wrap stiffeners 32*a*, which are inserted into the integral sleeve 30*c* provided at the top of the poly-wrap panel 30*a*, poly-wrap top seal foam gaskets 33, and top seal clips 34 to provide vertical support for sheeting panel 30*a* after deployment.

Poly-wrap stiffeners 32*a* are approximately ¾" wide by ⅛" thick solid rigid bar material made of PVC or other hard plastic to provide lateral support for sheeting panel 30*a* at its upper end during emergency deployment. Stiffeners 32*a* are manufactured to a standard length of approximately 8 feet and are cut-to-fit and labeled during pre-flood prep to ensure proper fit. Stiffeners 32*a* have a female coupler 32*b* on one end with inside dimensions of slightly larger than ¾" wide by ⅛" high by 1½" deep that facilitate connecting multiple bar sections to accommodate longer spans as required. The upper edge of sheeting panel 30*a* is manufactured with an integral approximately 1" wide plastic sleeve 30*c* to receive the poly-wrap stiffener bars 32*a*.

Top seal gaskets 33 are made from J-shaped closed-cell foam material (approximately 2" wide and ¼" thick) and are custom fitted to the required lengths of poly-wrap panels 30*a* and labeled during pre-flood prep to facilitate emergency deployment. An integral tab 31*g* is provided approximately 2" below the top of the square tube riser 31*e* along its inside edge to ensure proper positioning of top seal gasket 33 during deployment.

Top seal clips 34 are deployed along the top of sheeting panel 30*a* approximately midway between each vertical wall riser 31*a* to secure the top seal gasket 33 to the outside edge of sleeve 30*c* containing the stiffeners 32*a* at the top of the sheeting panel 30*a* before tucking the sleeve 30*c*, stiffeners 32*a*, and top seal gasket 33 behind the upper end of the vertical wall risers 31*a* to compress the top seal gasket 33 against wall 5*a*, 6*a*. Top seal clips 34 are made from spring steel or aluminum (approximately ¾" wide) and have a design similar to a garage door remote visor clip.

During deployment, one person holds the top of the sheeting panel 30*a* in place after first securing the male zipper connection 30*b* at the bottom of panel 30*a* into the female zipper connection 28*c* of the zipper strip 28*a*, inserting the stiffeners 32*a* into the sleeve 30*c* at the top of the panel 30*a*, and installing the top seal gasket 33 using the top seal clips 34 while a second person tucks the sleeve 30*c*, stiffener 32*a*, and top seal 33 behind the square tube riser 31*e* of each vertical wall riser 31*a* to anchor the sheeting panel 30*a* at its top end near the DFE 3. The compression force against the exterior wall 5*a*, 6*a* caused by tightening down the ¼" bolt or masonry screw used to install each vertical wall risers 31*a* creates sufficient force (elastic potential energy) at the top of each square tube riser 31*e* to maintain the vertical orientation of riser square tube 31*e* and compress the top seal gasket 33 thereby creating the needed water-resistant barrier at the top of the poly-wrap panels 30*a* adjacent to exterior wall 5*a*, 6*a* at the DFE 3 after deployment. The top seal gasket 33 is designed to repel the majority of rain water runoff down the side of the exterior wall 5*a*, 6*a*.

Spring bars 36*a* are used with spring bar foam gaskets 36*c* for anchoring and sealing poly-wrap sheeting panel 30*a* vertically against exterior walls 5*a*, 6*a* along the sides of the sheeting panel 30*a* and/or along the corners of exterior walls 5*a*, 6*a* to compartmentalize the house wrap solution (e.g. each run of exterior wall may be configured as a separate water proof compartment). The solid approximately 1" wide by ⅛" thick spring bars 36*a* are manufactured from spring steel or aluminum in a variety of standard lengths up to 12 feet long with an outward flexure. Spring bars 36*a* have an approximately ⅛" thick integral rubber gasket which is pre-adhered to the bottom side of the concave surface during the manufacturing process to effectively anchor the sheeting panel 30*a* between the spring bar 36*a* and spring bar foam gasket 36*c*. Spring bar foam gaskets 36*c* are comprised of approximately 1" wide by ⅜" thick closed-cell foam run the entire length of each spring bar 36*a* to enable the edge of sheeting panel 30*a* to be sandwiched between the exterior wall 5*a*, 6*a* and each spring bar 36*a* installed in a vertical orientation. Spring Bars 36*a* and spring bar foam gaskets 36*c* may be cut-to-fit specific building house wrap requirements and are custom fitted and labeled during pre-flood prep to facilitate emergency deployment.

When used for anchoring and sealing sheeting panel 30*a* in vertical orientations, spring bars 36*a* extend from approximately GLE 2 to the DFE 3 and are anchored at both ends, with either a) ¼" hex bolts 36*i* screwed into pre-set threaded anchors 36*h*, or *b*) ¼" masonry (or wood) fasteners screwed into pre-drilled 3/16" holes after inserting the sheeting material of panel 30*a* between the spring bar 36*a* and a spring bar foam gasket 36*c*. During deployment, one person holds spring bar foam gasket 36*c* and sheeting panel 30*a* in place while another person deploys the spring bar 36*a* using a cordless drill and bolt fasteners 36*i* (or screws) to compress the spring bar foam gasket 36*c*. Tightening the fasteners 36*i* will straighten the spring bar 36*a* while compressing the spring bar foam gasket 36*c* against exterior wall 5*a*, 6*a*, thus making a water tight seal.

Poly-wrap containers 35*a* are permanently mounted, vertically-oriented, low profile, sealed containers which may be optionally installed at unobtrusive locations along the side or corner of the building structure 1 to host up to two rolls of pre-fitted poly-wrap sheeting 30*a* in order to facilitate deployment of the house wrap system immediately preceding the flood event. The inside edge of the rolled plastic poly-wrap sheeting panel 30*a* is attached to the exterior wall 5*a*, 6*a* under the sealed container 35*a* using butyl tape 35*e*.

The containers 35*a* may be manufactured from composite plastic material and are permanently installed to the exterior wall 5*a*, 6*a* from slightly above GLE 2 to the DFE 3 using masonry or wood screw fasteners. The containers 35*a* facilitate deployment of the sheeting panel 30*a* by first opening the sealed container door 35*b* by opening the compression fit latches 35*d* and rotating door 35*b* using hinges 35*c*, then unrolling the sheeting panel 30*a* against the exterior walls 5*a*, 6*a* from slightly above GLE 2 to DFE 3. When installed at the corner of walls 5*a*, 6*a*, two rolls of sheeting panel 30*a* may be hosted from a single container 35*a* having two sealed doors 35*b* to facilitate protection of adjacent walls 5*a*, 6*a*. For exterior walls 5*a*, 6*a* where the optional poly-wrap containers 35*a* are not used, the deployment process starts by anchoring and sealing the starting edge of poly-wrap sheeting panel 30*a* using a spring bar 36*a* with underlying spring bar foam gasket 36*c* to exterior wall 5*a*, 6*a*. After securing one end of the sheeting panel 30*a*, the roll of sheeting panel 30*a* may be unrolled along the length of the exterior wall 5*a*, 6*a* to be protected similar to the process that will be used if poly-wrap containers 35*a* are used to permanently store the roll of pre-fitted sheeting panel 30*a* on the side or corner of exterior walls 5*a*, 6*a*.

Figure 24:
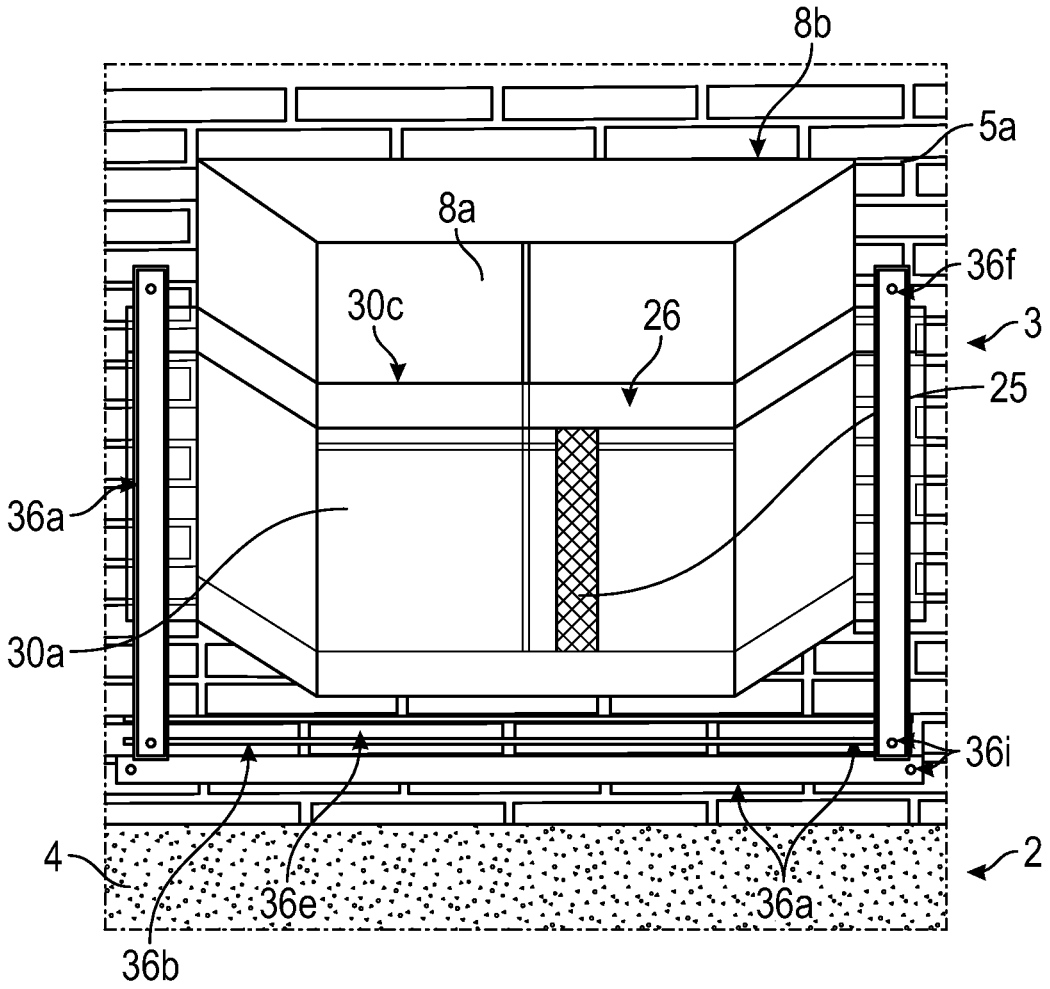
FIG. 24 is an elevation view of the home in FIG. 1 illustrating the house wrap system used to protect a low-lying bay window from flooding.

FIG. 24 illustrates the application of the House Wrap System to protect a bay window 8*a*, which extends below the DFE 3. During pre-flood prep, poly-wrap sheeting panels 30*a* are customized using an extrusion process to shape the sheeting material around the protruding area to be protected or alternatively using poly-plastic cut-outs, which have been heat/pressure sealed or taped to form a single waterproof panel fitted to the profile of the area to be protected. Fragile glass in each bay window 8*a* is protected from floating debris during flooding by using either rigid plastic lattice panels 25 or alternatively batting panels, which will have been previously custom-fitted to the area to be protected and labeled during pre-flood prep to facilitate deployment. Rigid plastic lattice panels 25 are made from hard plastic and may be cut-to-fit from their standard size of approximately 1/16" thick by 35" wide by 24" tall.

For masonry veneer walls 5*a*, horizontally-oriented spring bars 36*a* and spring bar zipper gaskets 36*d* may be used to seal the lower end of sheeting panels 30*a*. Spring bar zipper gaskets 36*d* are made by bonding together the following components: (a) approximately 1" wide by 3/8" thick closed-cell foam gasket material, (b) integral dual female zipper connection 36*e* mounted on an approximately 2" wide 10 mil polyethylene plastic tab, and (c) approximately 1" wide by 1/8" thick foam gasket. In this application, spring bar zipper gaskets 36*d* are deployed between the exterior wall 5*a* located immediately below the bay window 8*a* and the spring bar 36*a* during emergency deployment using a process similar to how spring bar gaskets 36*c* are deployed. Tightening down on the hex bolt fasteners 36*i* (or screws) inserted through the 5/16" hole 36*f* at each end of spring bar 36*a*, compresses the foam material contained within spring bar zipper gaskets 36*d* against exterior wall 5*a* and firmly anchors and seals the female zipper connections 36*e*, which will be used to mate with the male zipper connections 30*b* of the sheeting panels 30*a*. Alternatively, horizontal-oriented spring bars 36*a* and spring bar foam gaskets 36*c* may be used to seal the bottom of the poly-wrap sheeting panel 30*a*. Vertically-oriented spring bars 36*a* and spring bar foam gaskets 36*c* are used to seal the sides of the poly-wrap sheeting panel 30*a*. All weather tape 26, which may be applied in both dry and wet conditions, is used to seal the top of the sheeting panel 30*a* at the DFE 3.

Figure 25:
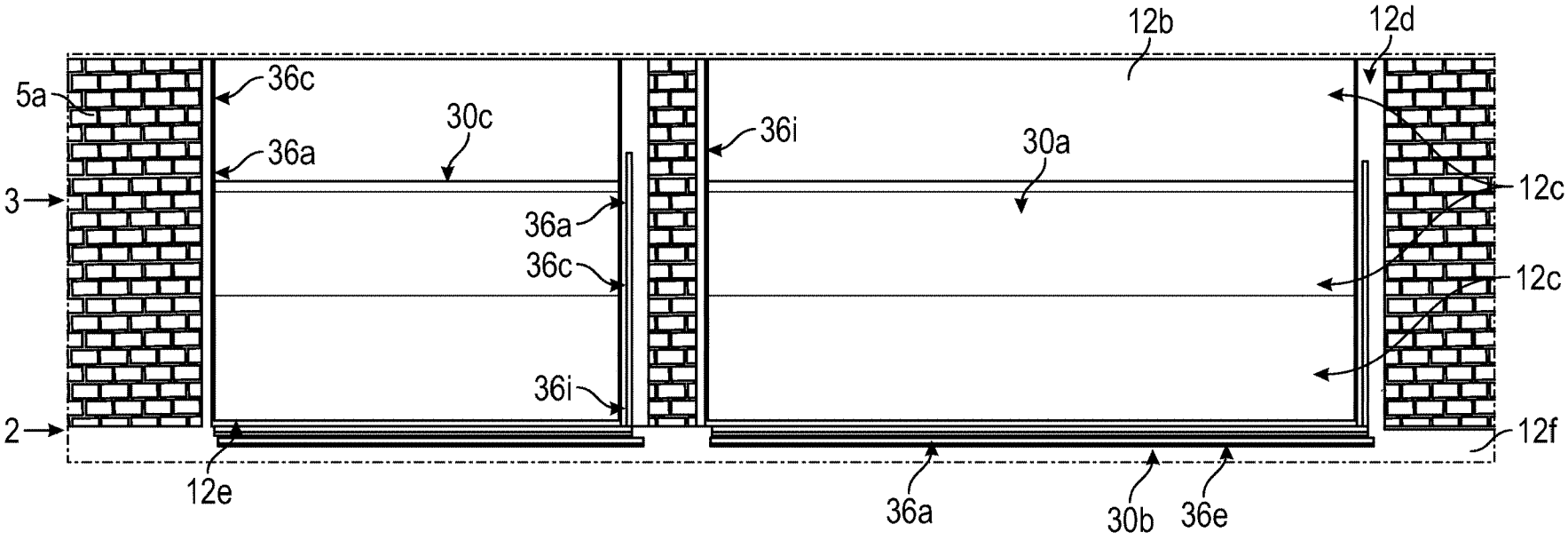
FIG. 25 is an elevation view of the home in FIG. 2 illustrating the house wrap system used to protect a sectional type garage door from flooding.

Referring now to FIG. 25, sectional type garage doors 12*b* adjacent to masonry veneer walls 5*a* with articulated horizontal door panels 12*c* may also be protected to a height at or above the DFE 3 using the integrated House Wrap System. For deployment of poly-wrap sheeting panels 30*a* of a suitable width (e.g. 36" or 46") across sectional-type garage doors 12*b* immediately preceding the flood event, the upper sleeve 30*c* of the sheeting panel 30*a* is simply tucked into the closest articulated joint of door panels 12*c* located above the DFE 3 prior to completely closing the garage door 12*b*. Upon fully closing garage door 12*b*, the upper end of sheeting panel 30*a* will be fully secured at a height slightly above the DFE 3. After securing the upper end of sheeting panel 30*a*, each side of sheeting panel 30*a* will be anchored and sealed within the frames 12*d* of garage door 12*b* using vertically-oriented spring bars 36*a* and spring bar foam gaskets 36*c* with suitable fasteners 36*i*. The bottom 12*e* of garage doors 12*b* are sealed to the driveway substrate 12*f* using horizontally-oriented spring bars 36*a* and spring bar zipper gaskets 36*d* with suitable fasteners 36*i* and mating the male zipper connections 30*b* of sheeting panels 30*a* with the female zipper connections 36*e* of the zipper gaskets 36*d* or alternatively using spring bar foam gaskets 36*c* to seal the sheeting panels 30*a* directly against the driveway substrate 12*f*. All components of the House Wrap System for protecting sectional type garage doors 12*b* should be configured and labeled during pre-flood prep to facilitate emergency deployment.

Figure 26:
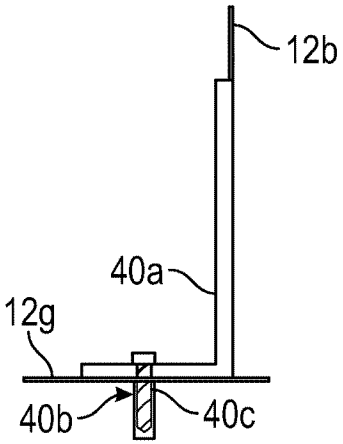
FIG. 26 is an elevation view of a garage door support strut used in the house wrap system to reinforce a garage door against forces from flood waters.
Figure 27:
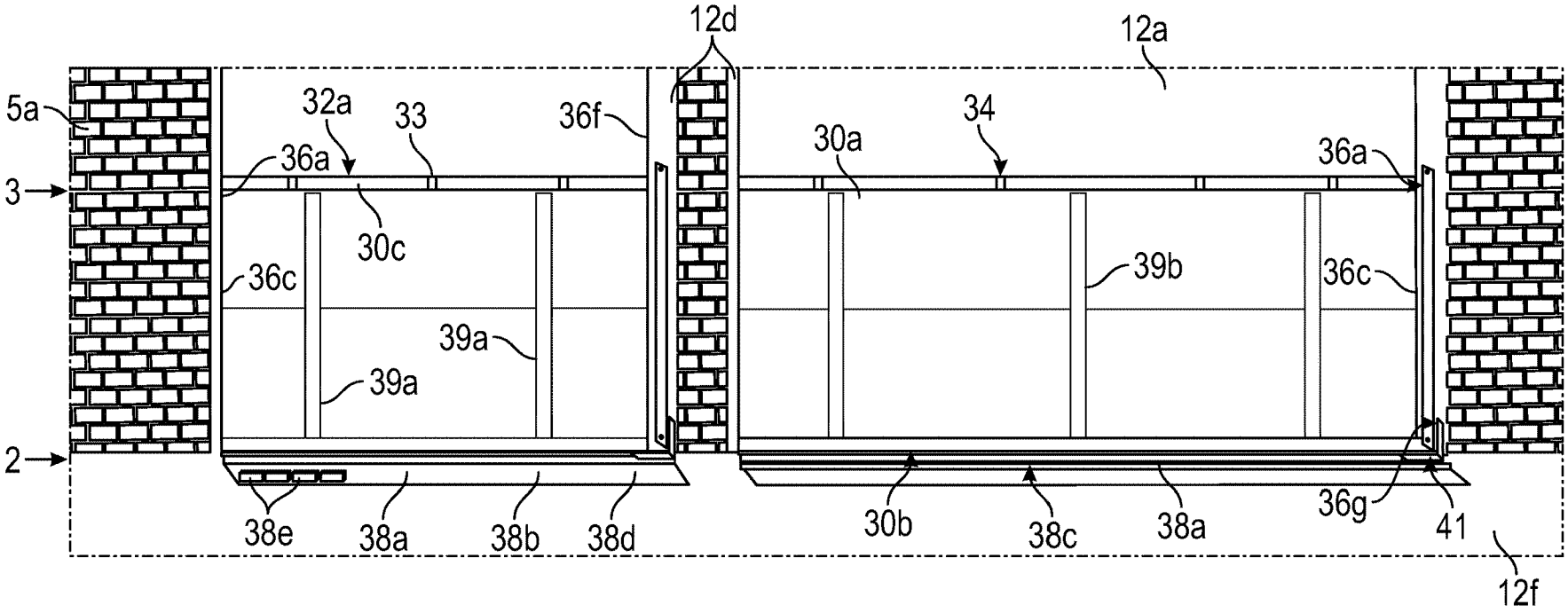
FIG. 27 is an elevation view of the home in FIG. 2 illustrating garage door risers, zipper mats, and other components used in the house wrap system to protect a non-sectional or solid type garage door from flooding.
Figure 28:
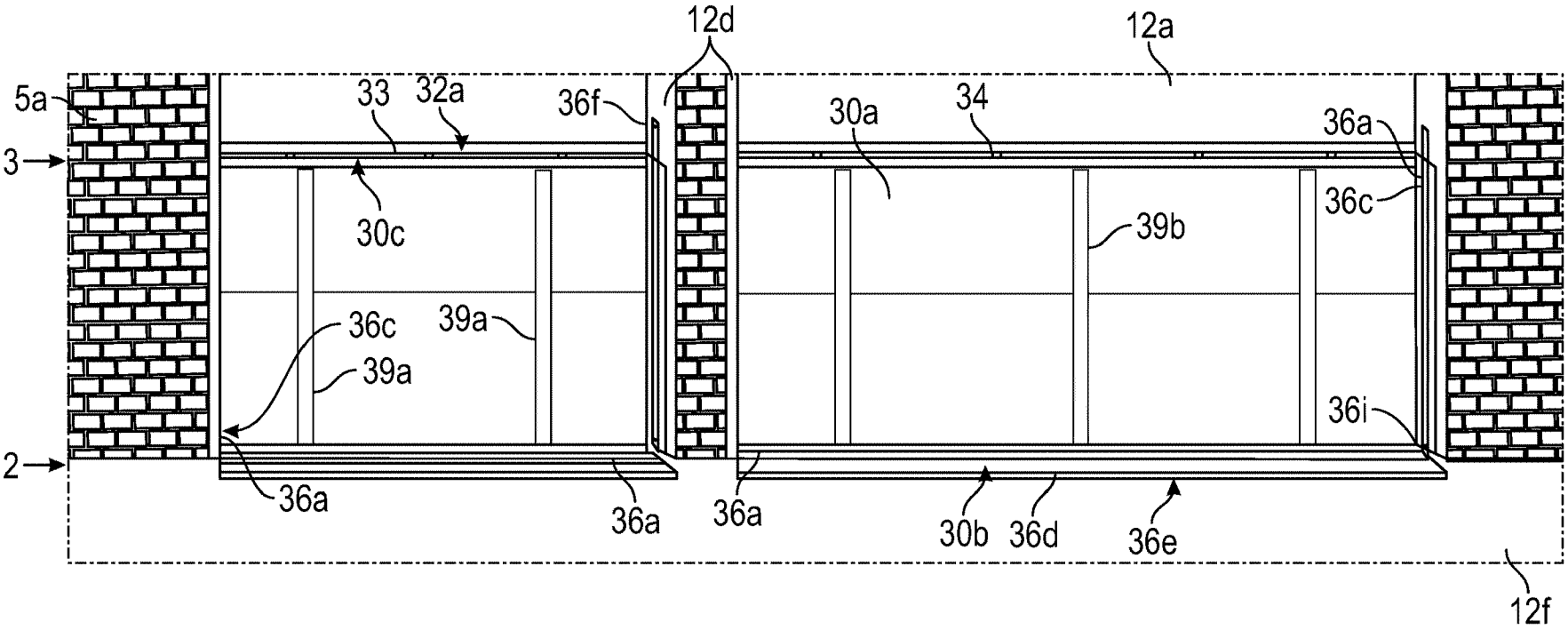
FIG. 28 is an elevation view of the garage in FIG. 2 illustrating spring bars, zipper gaskets, and other components used in the house wrap system to protect a non-sectional or solid type garage door from flooding.
Figure 29:
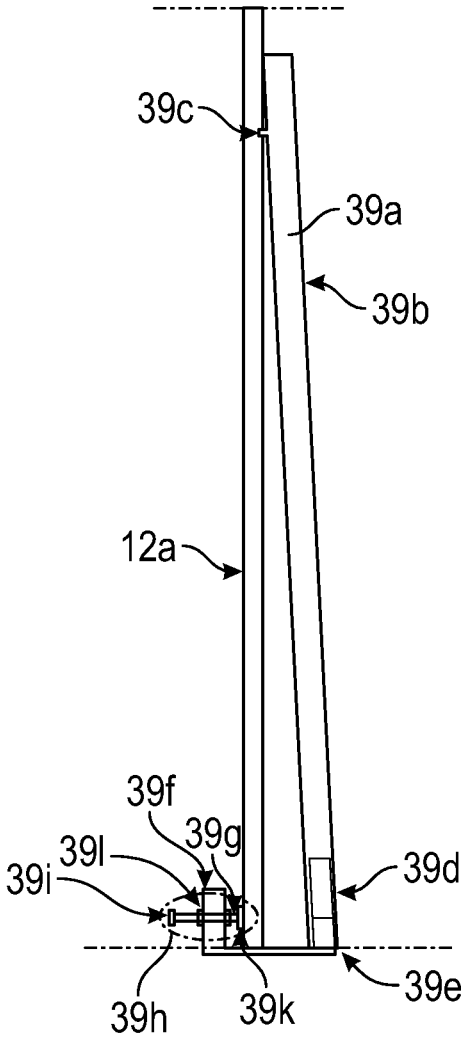
FIG. 29 is an elevation view of a garage door riser in FIG. 27.
Figure 30:
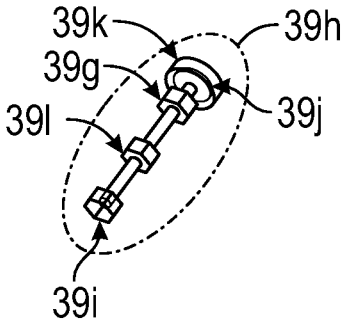
FIG. 30 is an expanded view of the area **39*h* in FIG. 29** illustrating the components used to secure a garage door riser.

FIG. 26 illustrates how garage door support struts 40*a* may be pre-configured to facilitate emergency deployment on the inside of garage doors for reinforcement to ensure the garage doors 12*b* can handle the hydrodynamic forces imparted by encroaching flood waters. Support struts 40*a* are L-brackets with an approximately 1' long horizontal member having a 5/16" mounting hole for anchoring to the garage floor substrate 12*g* and an approximately 2' long vertical member, which will be aligned with the inside of garage door 12*b*. Each support strut 40*a* is pre-configured during pre-flood prep by pre-setting a 1/4" threaded masonry anchors 40*b* into garage floor substrate 12*g* for use with hex bolt fasteners 40*c*. Support struts 40*a* should be deployed approximately every 4' along the inside of the garage door 12*b* during emergency deployment immediately preceding the flood event using 1/4" bolt fasteners 40*c* to maintain the support struts 40*a* in the proper position along in garage floor substrate 12*g*.

FIGS. 27-30 illustrate how the House Wrap System is used to protect non-sectional type garage doors 12*a* adjacent to masonry veneer walls 5*a*. The first deployment step includes securing J-shaped garage door risers 39*a* approximately every 4 to 6 feet along the base of garage door 12*a*, which are used to provide vertical support for poly-wrap sheeting panels 30*a* adjacent to non-sectional type garage doors 12*a*.

Garage door risers 39*a* are designed to wrap around bottom end of garage door 12*a* when the garage door 12*a* is closed. Each garage door riser 39*a* is comprised of the following components: (a) vertically-oriented inner frame 39*f* made from approximately 3/4" aluminum or steel square tube with a height of approximately 2" is welded at a 90° right angle onto the outer edge of a horizontally-oriented aluminum or steel base plate 39*e* with approximate dimensions of 1/4" thick by 1" wide by 5" long, (b) vertically-oriented outer riser stub 39*d* also made from approximately 3/4" aluminum or steel square tube with a height of approximately 3" is welded onto the other end of base plate 39*e* with an approximately 3° angled inward cant (toward garage door 12*a*), (*c*) an approximately 5/16" hole protruding through the inner frame 39*f* approximately 1" above base plate 39*e*, which has a 1/4" nut 39*g* welded on the inside of the inner frame 39*f* adjacent to the hole, (d) a riser tightening apparatus 39*h* comprised of a 1/4" diameter by approximately 2.5" long threaded bolt 39*i* with a 1/4" lock nut 391, which is then screwed into the 1/4" welded nut 39*g* and an approximately 3/4" diameter round threaded pressure plate 39*j*, which screws onto the end of the bolt after installation into the 1/4" welded nut 39*g*. Prior to securing the riser tightening apparatus 39*h*, an approximately 24" tall vertically-oriented riser 39*b* made from 1" square tube aluminum or steel and having a tab or clip 39*c* at its upper end is slid over the inward slanting 3/4" stub 39*d* located adjacent to the outside edge of the garage door 12*a*. After tightening the garage door riser 39*a* to the bottom 12*e* of the garage door 12*a*, the 1/4" lock nut 39*l* secures the garage door riser 39*a* in place. Garage door risers 39*a* are tested and labeled during pre-flood prep.

Figure 22:
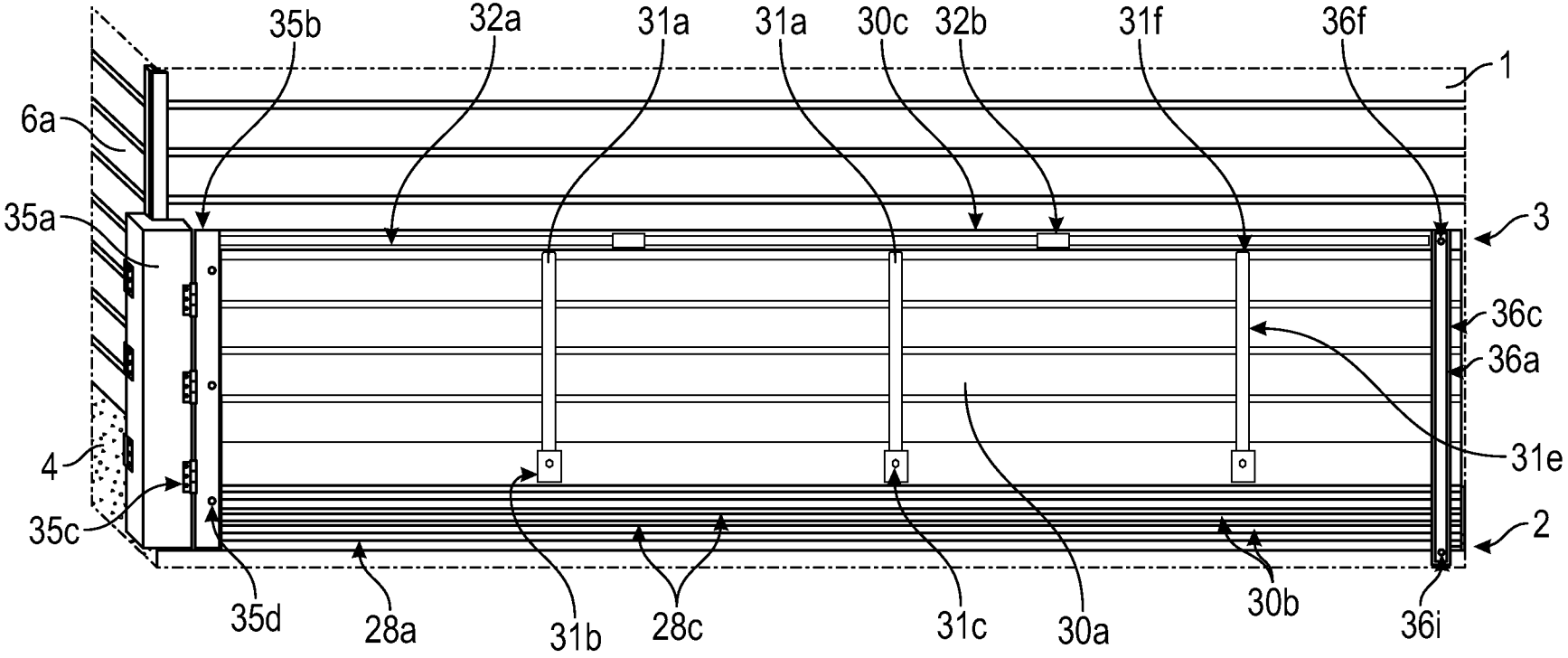
FIG. 22 is an elevation view of the home in FIG. 1 illustrating a poly-wrap sheeting panel, stiffeners and other components used in the house wrap system in an early stage of deployment.
Figure 23:
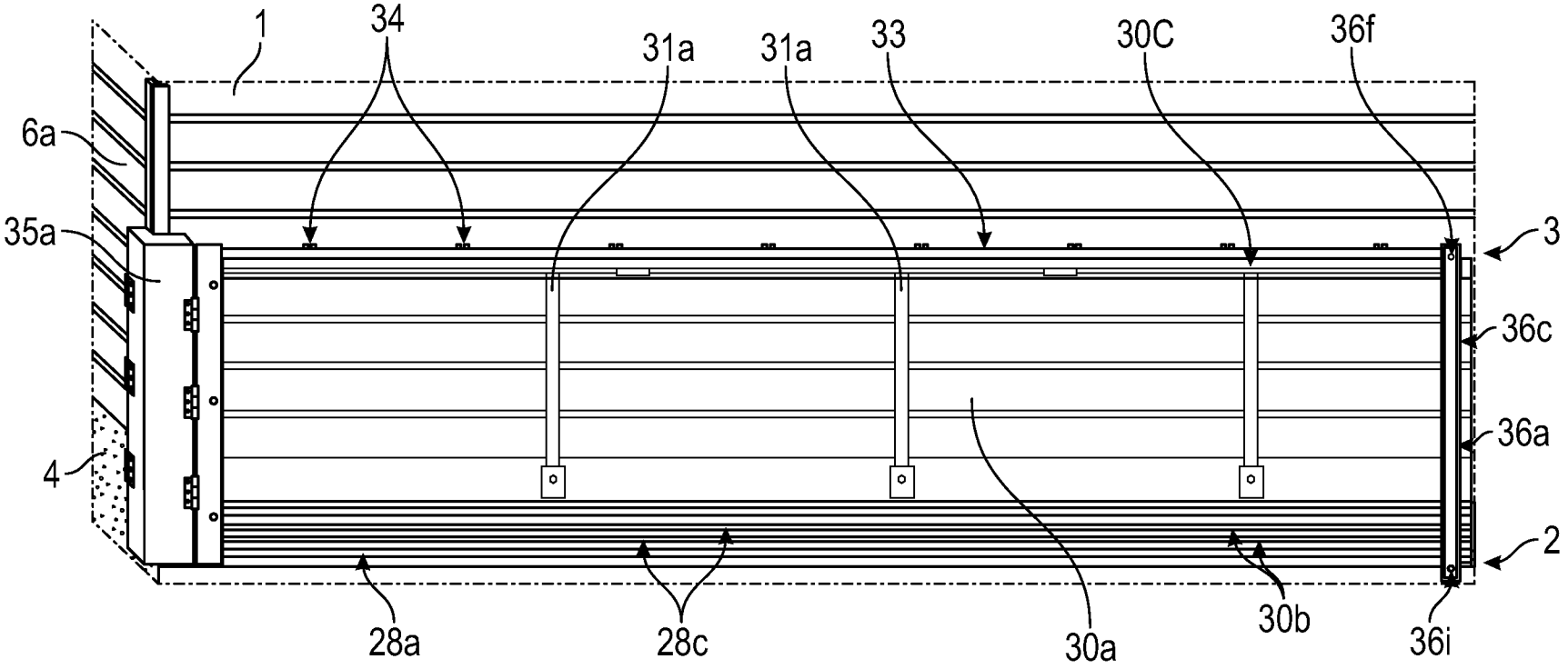
FIG. 23 is another elevation view of the home in FIG. 1 illustrating a top seal gasket, top seal clips and other components used in the house wrap system in an later stage of deployment.

Garage door risers 39*a* are used with poly-wrap panels 30*a*, poly-wrap stiffeners 32*a* contained within sleeves 30*c*, poly-wrap top seal gasket 33, top seal clips 34, spring bars 36*a*, spring bar foam gaskets 36*c*, and zipper mats 38*a* to protect the area around garage door 12*a* in a manner similar to the function of the vertical wall risers 31*a* in FIGS. 22-23. Approximately 12" wide zipper mats 38*a* are deployed along the front of garage door 12*a* after initial deployment of the garage door risers 39*a* and represent an alternate method to spring bars 36*a* and spring bar zipper gaskets 36*d* for hosting the dual female zipper connections 38*c* to mate with dual male connections of the sheeting panels 30*a* at floor substrates. The base material 38*b* of zipper mats 38*a* should be suitable flexible water proof fabric such as approximately 30 durometer closed-cell waterproof neoprene, which is approximately 1/16" thick. Zipper mats 38*a* host an integral dual female zipper connection 38*c* along one edge and on the top of the base material 38*b*. The underside of the base material 38*b* hosts an approximately 3/4" wide by 5/16" thick closed-cell foam strip 38*d* along the opposite edge to where the dual zipper connection 38*c* is hosted and another similar foam strip 38*d* near the center of the approximately 12" wide base material 38*b*. The underside foam strips 38*d* are compressed by placing a weight distributing board (e.g. 2" high by 8" wide pine board) and water-activated sand-less weight bags, sand filled bags, bricks, rocks, or any other weighting material 38*e* on the top side of zipper mats 38*a* and with a slight offset to the dual female zipper connection 38*c*. The plastic male zipper connections 30*b* on the bottom of the sheeting panels 30*a* in front of garage doors 12*a* are then attached to the female zipper connections 38*c* of zipper mats 38*a*. Zipper mats 38*a* are available in bulk rolls and may be cut-to fit using scissors to facilitate customized solutions to accommodate specific House Wrap System requirements and specifically in substrate areas where zipper strips 28*a* and horizontally-oriented spring bars 36*a* with spring bar zipper gaskets 36*d* cannot be deployed effectively (e.g. in front of certain doors, porches, and patios).

Approximately 2.5" by 2.5" by 1/8" thick steel L-shaped corner braces 41 are used to aid in sealing the right-angle intersections between spring bars 36*a*, sheeting panels 30*a*, zipper strips 28*a*, and/or zipper mats 38*a* near GLE 2. Corner braces 41 have integral approximately 1" wide by 3/4" thick closed-cell foam gaskets, but in cases where additional gaps must be filled, spring bar foam gasket material 36*c* may be used. To deploy the corner braces 41 and gasket material 36*c*, one person holds poly sheeting 30*a* and/or the zipper mat 38*a* in place while a second person installs the corner brace 41 using a cordless drill and 1/4" screw fasteners 36*g* through four provided 5/16" holes along both ends of corner brace 41 and into pre-drilled 3/16" holes in the substrate 12*f* or exterior wall 5*a*. Tightening down on screw fasteners 36*g* of corner brace 41 anchors the sheeting panels 30*a* and/or zipper mat 38*a* while compressing its integral foam gasket and/or the additional foam gasket material 36*c*.

Figure 31:
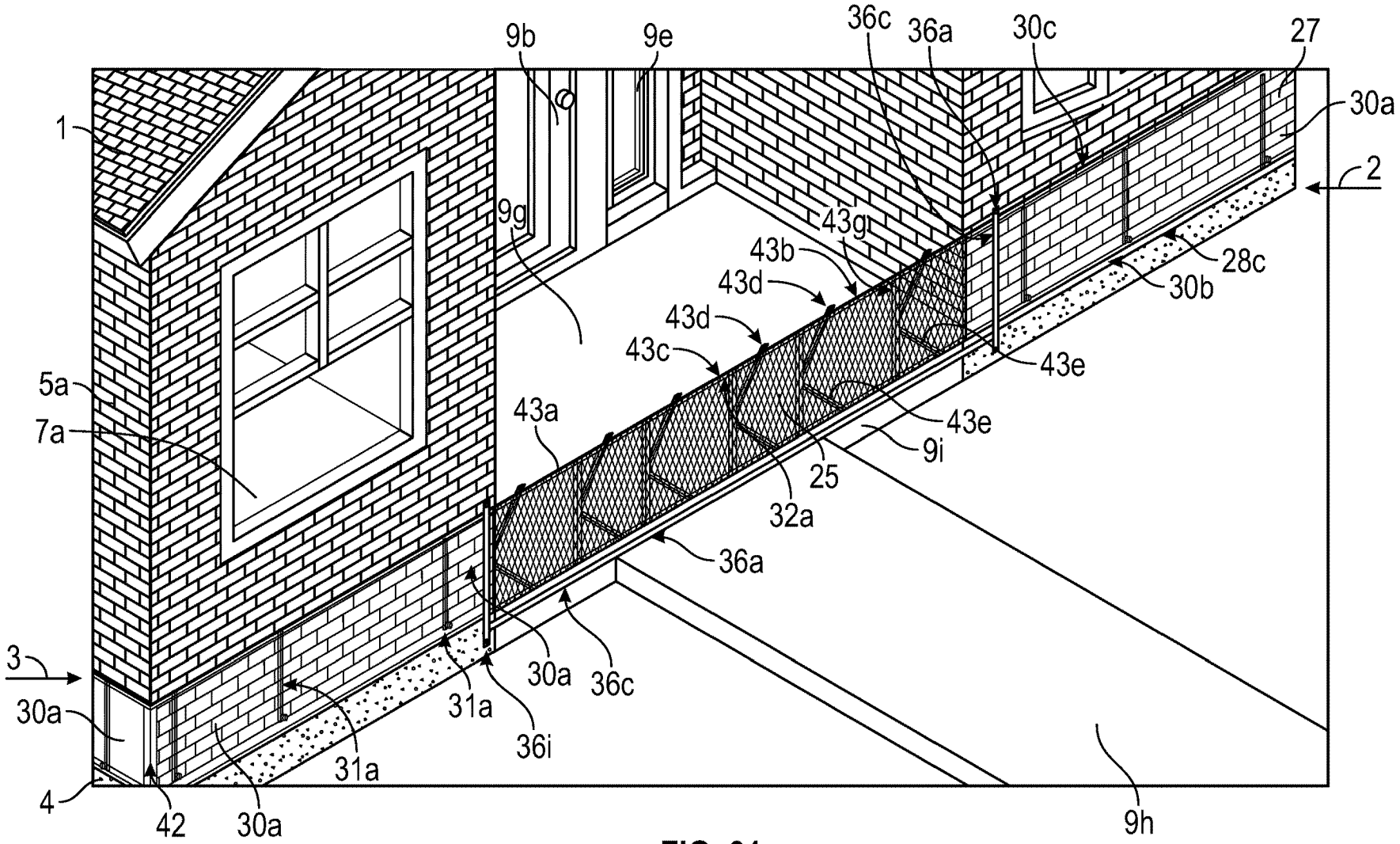
FIG. 31 is a perspective view of the home in FIG. 1 illustrating an entry way protection assembly used in the house wrap system to protect fragile doors and windows from flooding.
Figure 32:
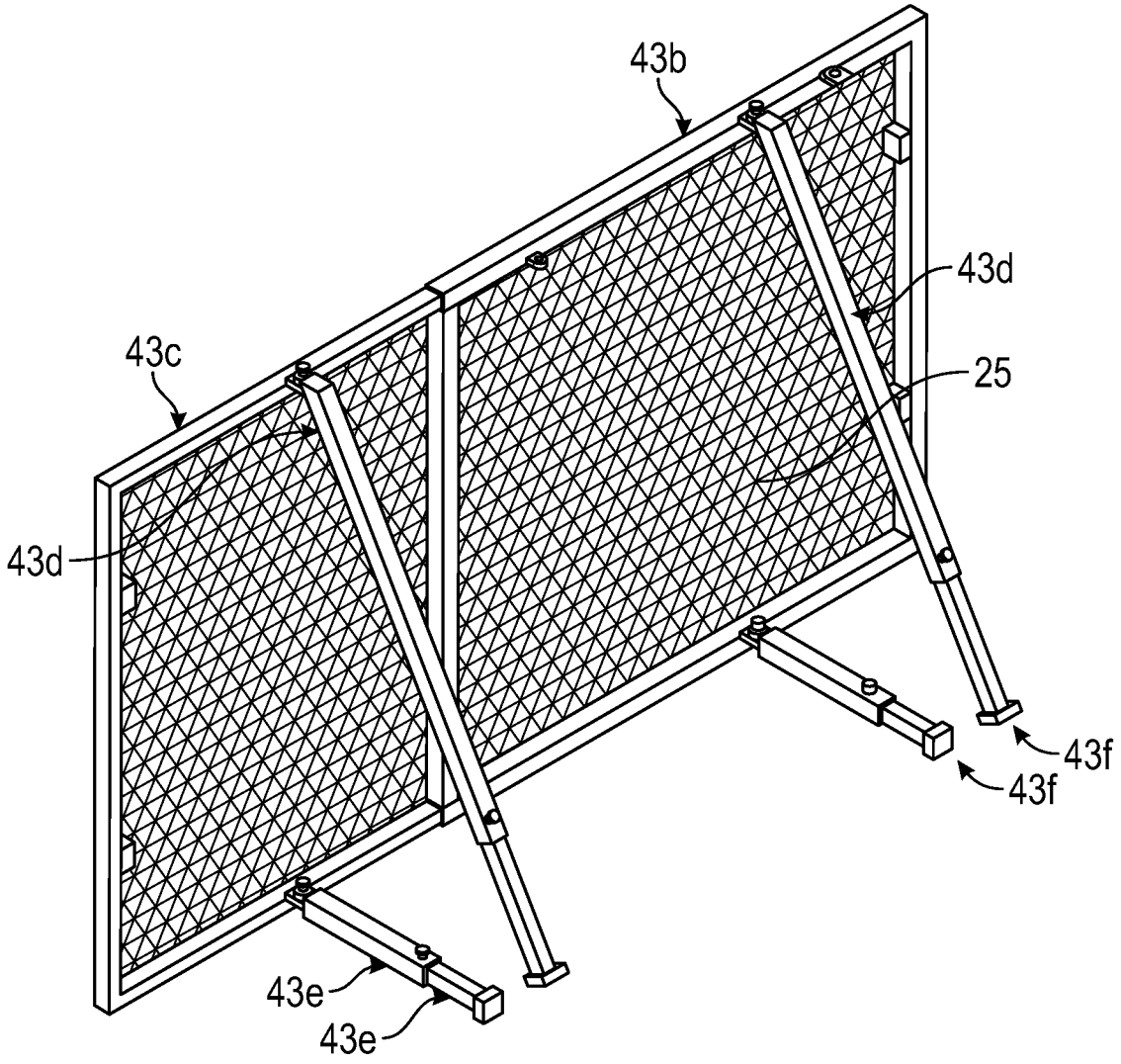
FIG. 32 is a perspective view of the entry way protection assembly components in FIG. 31.

Referring now to FIGS. 31-32, entryway protectors 43*a* are used to protect relatively fragile doors 9*b* and glass windows 9*e* at recessed exterior entryways 9*a* and are available in multiple pre-defined widths. Each pre-fitted protector assembly 43*a* includes an approximately 3/4" aluminum, PVC, or other hard plastic square tube male frame 43*c*, which telescopes into an approximately 1" female square tube frame 43*b* to expand and contract to fit the width requirement of the entryway 9*a*.

The bottom of the frames 43*b*, 43*c* are supported using either (a) pre-existing ledge or step 9*i* at the entryway 9*a* to prevent bottom of frames 43*b*, 43*c* from sliding toward to the building structure 1, (b) telescopic aluminum struts 43*d*, 43*e* spaced horizontally every approximately 3 to 6 feet along the front porch substrate 9*g* and being supported near GLE 2 against both the protector frame 43*b*, 43*c* and the nearest available ledge 9*i*, wall 5*a*, or exterior door 9*b* of the building structure 1, or (c) anchoring the bottom of the protector assembly 43*a* to a concrete or tile substrate 9*g*, 9*h* using hex bolts with pre-installed threaded anchors 43*g*, which are permanently set into the substrate 9*g*, 9*h*. Screw-in covers (not shown) may be used to camouflage the threaded anchors prior to deployment.

The top of the frames 43*b*, 43*c* are supported using either (a) telescopic aluminum struts 43*d* pinned to the top of the frames 43*b*, 43*c* and which extend to the bottom of the adjacent structural wall 5*a* or exterior door 9*b* or alternatively using pre-set threaded masonry anchors in the entryway substrate and 1/4" hex bolts 43*g* to prop the frames 43*b*, 43*c* up when loaded against the rising flood waters, (b) cementing an approximately 1 1/2" square tube by 18" long aluminum stanchion receiver post (not shown) into the ground or flooring substrate 9*h* during pre-flood prep such that the top of the receiver post is level with GLE 2 to facilitate installation of an L-shaped brace (not shown) made of 1 1/4" square tube aluminum by inserting the lower end of the brace into the receiver and bolting the body to the brace immediately preceding the flood event. A protective cover (not shown) may be used to protect and camouflage the stanchion receiver prior to deployment.

Exterior walls 5*a* on both sides of the entryway 9*a* provide vertical support to the protector assembly 43*a*. Rigid plastic lattice panels 25 are used to provide structural integrity for entryway protectors 43*a* so the House Wrap System can withstand the hydrodynamic forces of the encroaching flood waters at recessed fragile door and window entryway areas 9*a*. Poly-wrap sheeting panels 30*a* are sealed at the bottom using spring bars 36*a* with spring bar foam gaskets 36*c* or spring bar zipper gaskets, zipper mats, or zipper strips (not shown). The top of the sheeting panels 30*a* are secured by inserting poly-wrap stiffeners 32*a* into sleeves 30*c* at top of sheeting panel 30*a*, draping the top part of the sheeting panel 30*a* over protector assembly 43*a*, then clipping the sleeve 30*c* containing the stiffener 32*a* into slots built into the inside edge of the square tube frames 43*b*, 43*c* at the top of the protector assembly 43*a*. The roof overhang of building structure 1 is required to protect the area against wind-driven rain.

Rigid foam corner protectors 42 are L-shaped foam pieces (approximately 1/8" thick with 4" sides and 30" tall) used for protecting sheeting panels 30*a* from wind-induced abrasion at corners of exterior walls 5*a* and/or windows 7*a* after emergency deployment.

Figure 33:
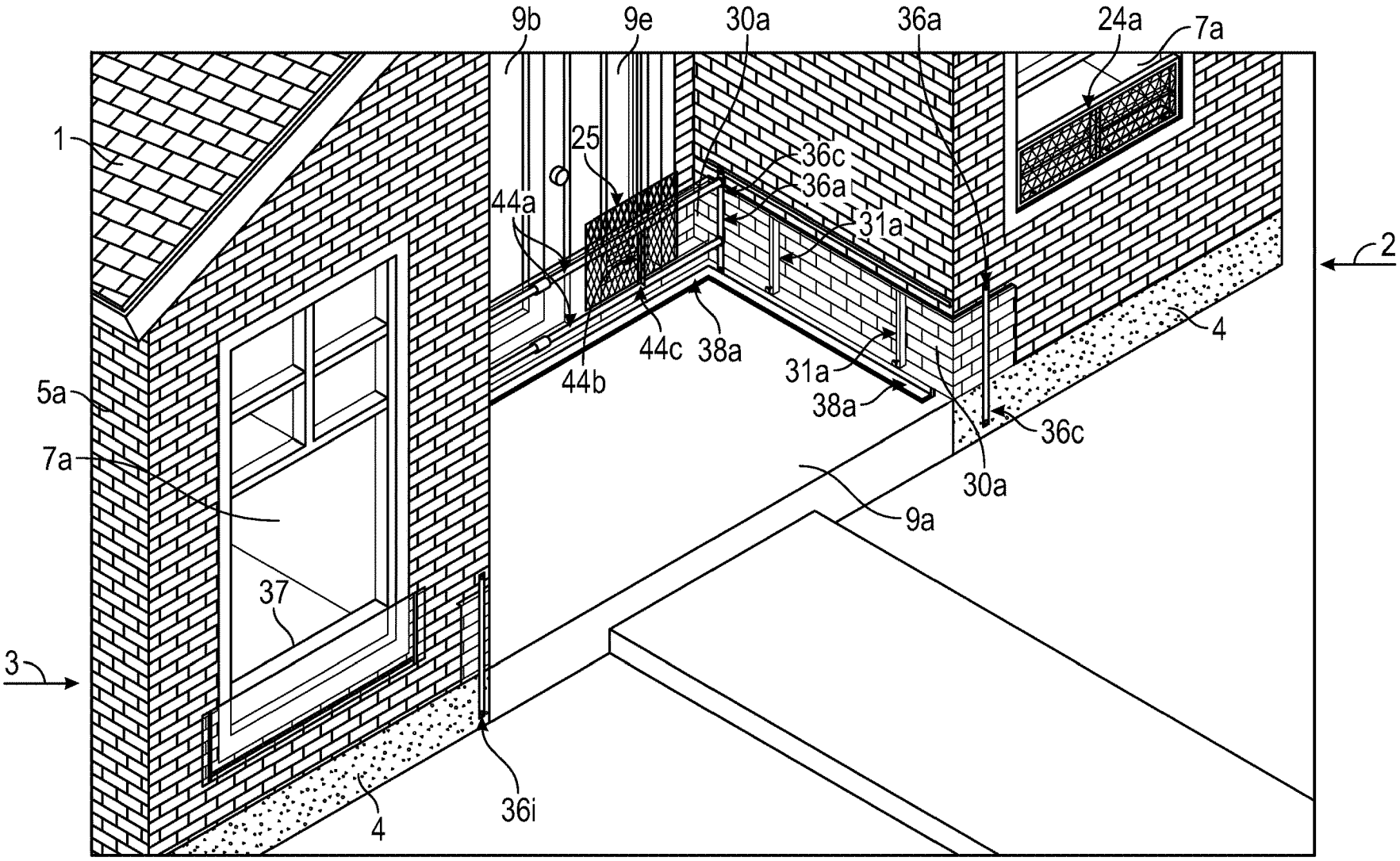
FIG. 33 is a perspective view of the home in FIG. 1 illustrating an alternate entry way protection system in the house wrap system to protect doors and windows from flooding.

FIG. 33 illustrates an alternative method to protect entryway 9*a*, recessed windows 7*a* extending below the DFE 3, and exterior doors 9*b* from encroaching flood waters. During pre-flood prep, a poly-wrap sheeting panel 30*a* is sized and labeled to completely cover the horizontal span of window 7*a* and/or door 9*b* area to be protected from slightly above GLE 2 to the DFE 3. For window applications, the bottom of the sheeting panel 30*a* is anchored and sealed against the exterior wall 5*a* using either (a) a pre-sized and labeled spring bar 36*a* with a spring bar foam gasket 36*c* at a location just below the window 7*a* using hex bolt fasteners 36*i* screwed into pre-set wall anchors 36*h* (or screws) or (b) using zipper strips (not shown). For door applications, the bottom of the sheeting panel 30*a* will be sealed using a zipper mats 38*a*. Both sides of the sheeting panels 30*a* are anchored and sealed against the exterior wall 5*a* using pre-sized and labeled spring bars 36*a* and spring bars gaskets 36*c* using bolt fasteners 36*i* (or screws). During emergency deployment for recessed window 7*a* applications, the upper end of the sheeting panel 30*a* is sealed at the DFE 3 using all weather wet/dry tape 26, which is removable after the flood event passes. Batting panels 37 are used to substantially fill window 7*a* and door 9*b* recesses with soft padding material sealed in plastic wrap so that the filled surface is approximately flush with the adjacent exterior walls 5*a*, which facilitates faster deployment of simple rectangular-shaped sheeting panels 30*a* using spring bars 36*a* and spring bar foam gaskets 36*c*. Batting panels 37 are made from recycled compressed denim (or other suitable padding material) and should be available in various thicknesses to facilitate custom fitting during pre-flood prep.

During a flood event, the batting material 37 also offers protection for glass and other fragile components of the window 7*a* and door 9*b* areas against impact damage from floating debris. Alternatively, pre-fitted rigid plastic latticework panels 25 may be used to protect the fragile window 7*a* and/or door 9*b* areas.

Expansion bars 44*a* may be used as an alternative to ¼" bolt fasteners 36*i* and pre-set threaded anchors 36*h* to compress each end of the spring bars 36*a* with spring bar foam gaskets 36*c*, which seal the sheeting panel 30*a* along both of its side edges against the exterior wall 5*a*, recessed window frame 7*b*, or door frame 9*c*. Both sides of the sheeting panel 30*a* are anchored and sealed against the exterior wall 5*a* using pre-sized and labeled spring bars 36*a* with spring bar foam gaskets 36*c* using one expansion bar 44*a* positioned across the top and another positioned across the bottom of the door 9*b* or recessed window 7*a* to be protected. Expansion bars 44*a* are approximately 1" in diameter and are manufactured of steel or aluminum with a design similar to ratchet-type cargo bars or spring-loaded, rotation-actuated tension bars. Expansion bars 44*a* are used to apply the force necessary to straighten spring-loaded spring bars 36*a* and compress its underlying foam gasket 36*c* to anchor and seal the sheeting panel 30*a* against the exterior wall 5*a*. Expansion bars 44*a* are available in multiple length ranges (e.g. 30-70" and 71-104"). One or two vertically-oriented aluminum or PVC cross-support struts 44*b* may be used to stabilize the two expansion bars 44*a*. C-shaped end clips 44*c* on the cross-support struts are designed to attach to the expansion bars 44*a* to ensure they do not bow inward or outward.

Figure 34:
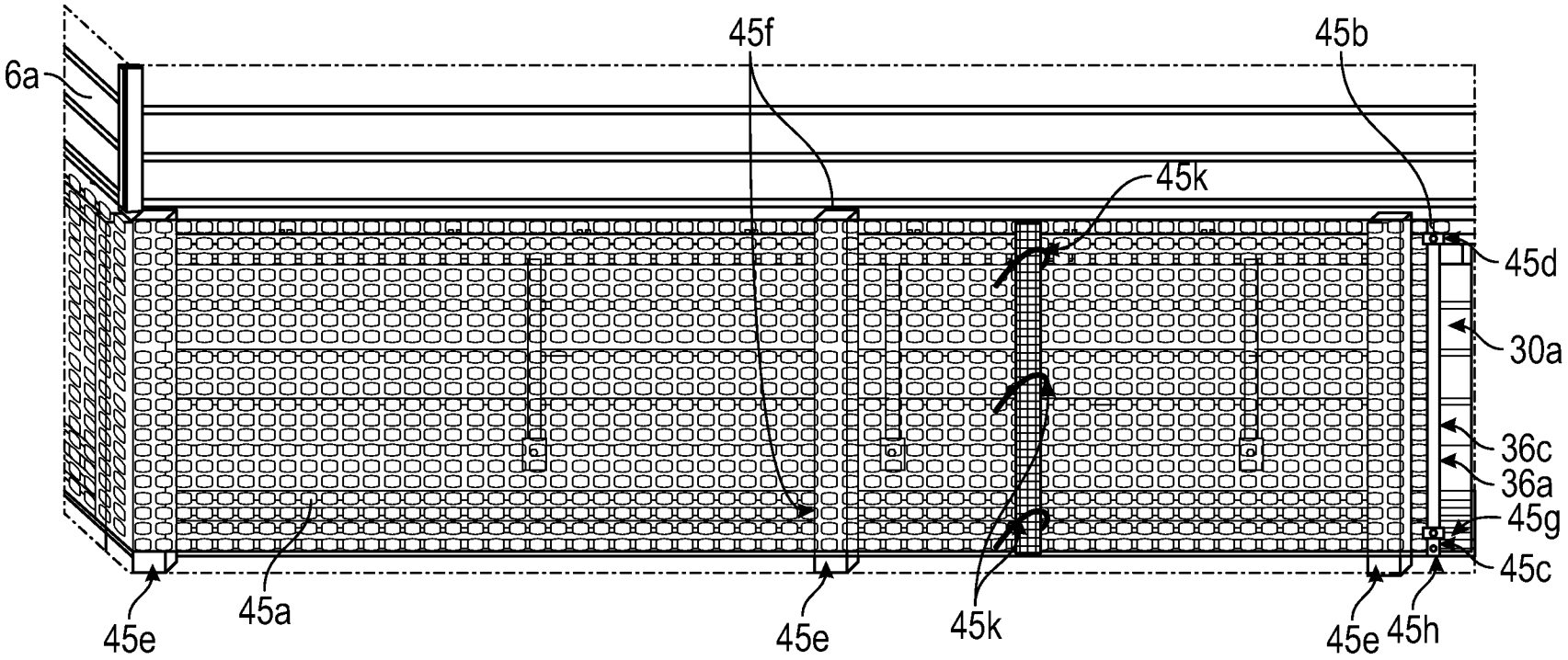
FIG. 34 is a perspective view of the home in FIG. 1 illustrating an optional debris barrier used in the house wrap system to provide additional protection from flooding.

Referring now to FIG. 34, an optional debris barrier solution is disclosed, which includes light-weight square mesh plastic netting, which is pre-fitted to cover walls, windows, and doors where the House Wrap System has been deployed. The debris barrier solution may be quickly deployed immediately preceding an impending flood to protect the poly-wrap against damage from wind and floating debris. Debris barrier netting 45*a* deployed from rolls is approximately 36" wide and has approximately 1.25" square mesh and is made from high yield strength LLDPE or similar plastic material. The netting 45*a* initiates and terminates into spring bars 36*a* or using suitable fasteners at wall corners or other locations along an exterior wall 6*a* as a final step to protect the house after installation of poly-wrap sheeting panels 30*a*. The netting material 45*a* is cut-to-fit and labeled during pre-flood prep along with related solution components to facilitate emergency deployment. Each end of the pre-fitted netting material 45*a* includes a vertically-oriented debris barrier tension bar 45*b*, which is weaved into the square mesh during pre-flood prep. These approximately 1" wide by ⅛" thick by 30" tall bars 45*b* are made from steel or aluminum and are either latched onto previously deployed spring bars 36*a* using J-hook flat washers 45*c* (or other suitable means) or the 5/16" holes 45*d* pre-drilled at both ends to accommodate ¼" bolt fasteners 45*h* screwed into preset wall anchors 45*g* during emergency deployment.

Deployment includes first positioning debris barrier spacer blocks 45*e* in a vertical orientation extending from GLE 2 to above the DFE 3 on both sides of each outward-facing corner of exterior wall 6*a*, within approximately 4" of each netting material 45*a* initiation/termination point, and in the case of relatively long exterior wall spans, every approximately 10 ft. The spacer blocks 45*e* are designed to provide approximately 6" standoff between the outer netting material 45*a* and the previously deployed poly-wrap sheeting panels 30*a*. The spacer blocks 45*e* are approximately 6" square by 36" tall and are made from lightweight, low cost, closed-cell extruded polystyrene foam (e.g. Styrofoam™). To facilitate emergency deployment of the netting material 45*a*, hook n' loop fasteners 45*f* (e.g. Velcro®) may be pre-installed on each end of the spacer blocks 45*e* (inner edge) and on the sheeting panels 30*a* at the planned deployment locations during pre-flood prep. These hook n' loop fasteners 45*f* ensure quick and easy positioning of the spacer blocks 45*e* in a vertical orientation at designed locations during deployment of the netting material 45*a* during inclement weather.

The next step in the deployment process includes anchoring one end of a netting material 45*a* in a vertical orientation from GLE 2 to the DFE 3 by latching a tension bar 45*b* onto a previously deployed spring bar 36*a* installed using J-hook flat washers 45*c* with ¼" bolt fasteners 36*i* screwed into threaded masonry anchors 36*h* pre-set into exterior wall 6*a*. An alternative method for anchoring the end of netting material 45*a* includes using ¼" bolts 45*h*, which extend through the 5/16" holes provided at each end of the tension bars 45*b* and directly into pre-set threaded anchors 45*g* in exterior wall 6*a* (or using screw-type fasteners). The netting material 45*a* is then unrolled to extend the high strength netting material 45*a* completely around the walls 6*a*, exterior doors, and windows to be protected before securing the other end of the netting material 45*a* using similar means. A single set of pre-set wall anchors 45*g* and ¼" bolt fasteners 45*h* may be used to secure the ends of two netting material 45*a* extending in different directions (e.g. double stack tension bars 45*b*). Multiple rolls of netting material 45*a* may be joined with approximately 4" zip ties 45*k* as required to cover longer deployment runs of netting material 45*a*. The pre-fitted and labeled netting panels 45*a* is sized such that the netting material 45*a* will be slightly taught after initial deployment by two people.

Debris barrier tensioner (not shown) is a lever-actuated, rack n' pinion ratcheting tool with integral dual 3-hook stretcher bars and is used along with approximately 4" zip ties 45*k* to further tighten the netting material 45*a* to provide the required netting tension to deflect floating debris and to apply compression force of the spacer blocks 45*e* against the previously deployed poly-wrap sheeting panels 30*a*. After engaging the mesh openings of the netting material 45*a* on both sides with the tensioner 45*j* in near full extension position, the rachet device of tensioner 45*j* is used to apply tensile force to the netting material 45*a* as it is pulled taught to compressed the spacer blocks 45*e* against the poly-wrap sheeting 30*a*, thus ensuring the protection of the components of House Wrap System from damage caused by wind and floating debris. A torque limiter is provided in the rack n' pinion device 45*j* to prevent damaging the various components of House Wrap System from overpull.

An alternative method for creating the final tension of netting material 45*a* without using the debris barrier tensioner 45*j* involves bunching the netting material 45*a* in middle of a panel run, then threading approximately 18" zip ties 45*k* through the mesh openings of netting material 45*a*, and then cinching down on the ties 45*k* either manually or using a zip tie tensioning tool (e.g. cable tie tightening gun). The netting deployment will be designed to circumvent inner corners of exterior walls 6*a* whenever possible by directly spanning from outer corner to outer corner of exterior walls 6*a*.

Figure 35:
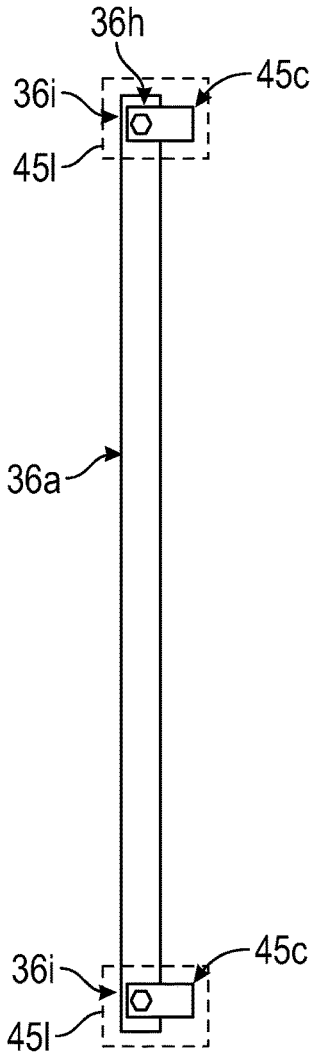
FIG. 35 is a plan view of the spring bar in FIG. 34.

FIG. 35 is a plan view of a spring bar 36*a* deployed using J-hook flat washers 45*c* of the optional debris barrier solution and ¼" bolts 36*i* screwed into threaded anchors 36*h* pre-set in exterior wall 6*a* with 451 highlighting the area around J-hook flat washer 45*c*.

Figure 36:
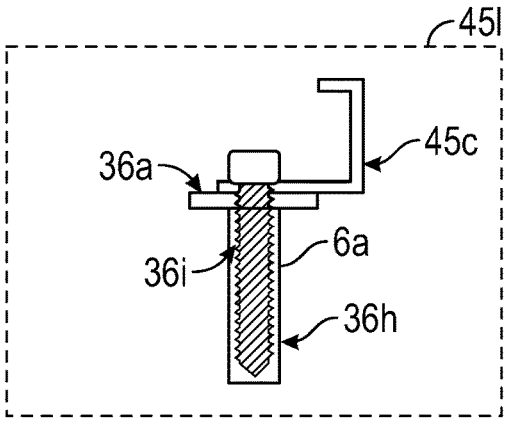
FIG. 36 is an expanded view of the area **45*l* in FIG. 35** illustrating the bolt and anchor used to secure the spring bar.

FIG. 36 is a side view of the area 451 in FIG. 35 and illustrates spring bar 36*a* deployed using J-hook flat washers 45*c* and ¼" bolts 36*i* screwed into threaded anchors 36*h* pre-set in exterior wall 6*a*.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for protecting a home or building with a slab-on-grade foundation from flood waters, which comprises:

securing a zip-lock strip along a section of the foundation adjacent at least one exterior wall;

attaching at least two vertical wall risers to the exterior wall or the foundation above the zip-lock strip, wherein each vertical wall riser is separated from an adjacent vertical wall riser by a predetermined distance and includes a top end extending at least to a predetermined design flood elevation (DFE);

interlocking a bottom end of a water proof, flexible sheet and the zip-lock strip to form a bottom-end horizontal water-resistant barrier, wherein a top the end of the flexible sheet includes an integral sleeve;

inserting a stiffener through the integral sleeve for lateral support of the top end of the flexible sheet;

securing a foam gasket over the integral sleeve containing the stiffener using a plurality of clips or clamps;

positioning the foam gasket and the integral sleeve containing the stiffener behind the top end of each vertical wall riser to form a top end horizontal water-resistant barrier at or above the DFE;

securing at least one side of the flexible sheet between a flexible spring bar and a spring bar foam gasket, with a predetermined length, to form a vertical water-resistant barrier near the at least one side of the flexible sheet.

2. The method of claim 1, wherein each spring bar foam gasket is secured along a portion of its length to the at least one exterior wall from above the top-end horizontal water-resistant barrier to a top edge of the foundation and is secured along another portion of its length to the foundation from the top edge of the foundation to below the bottom-end horizontal water-resistant barrier.

3. The method of claim 2, wherein each spring bar is secured at a top end to the at least one exterior wall above the top end horizontal water resistant barrier and is secured at a bottom end to the foundation below the bottom end horizontal water resistant barrier.

4. The method of claim 1, further comprising securing another side of the flexible sheet within a water resistant container attached to a corner of the at least one exterior wall for deploying the flexible sheet in at least one direction.

5. The method of claim 1, further comprising sealing one or more pre-existing weep-holes located above the zip-lock strip and forming one or more new weep holes above the zip-lock strip.

6. The method of claim 5, further comprising installing one of a removable weep hole plug and a removable weep hole screen in each of the one or more new weep holes for preventing flood waters and pests, respectively, from entering each weep hole.

7. The method of claim 1, further comprising forming one or more drainage holes above the top-end horizontal water resistant barrier for reducing hydrodynamic pressure on the at least one exterior well from flood waters that rise above the DFE.

8. The method of claim 1, further comprising positioning a rigid foam cover between a corner of the at least one exterior wall and the flexible sheet for protecting the flexible sheet.

9. The method of claim 1, further comprising installing a door protector adjacent an exterior side of each door in the at least one exterior wall to protect each door from flood waters up to at least the DFE.

10. The method of claim 1, further comprising installing a window protector adjacent an exterior side of each recessed window in the at least one exterior wall to protect each recessed window from flood waters up to at least the DFE.

11. The method of claim 1, further comprising covering each electrical outlet and each vent below the DFE in the at least one exterior wall.

12. The method of claim 1, further comprising sealing each toilet and each shower drain located at a ground level of the home or building.

13. The method of claim 1, further comprising sealing each wall appurtenance below the DFE in the at least one exterior wall.

* * * * *